United States Patent [19]

Baier et al.

[11] 4,103,692

[45] Aug. 1, 1978

[54] CIGAR WRAPPING MACHINE AND METHOD

[75] Inventors: Robert J. Baier, West Chester; Vern Anderson, Berwick; William S. Aseltine, Devon, all of Pa.

[73] Assignee: Gulf & Western Corporation, New York, N.Y.

[21] Appl. No.: 808,919

[22] Filed: Jul. 21, 1977

[51] Int. Cl.[2] ..... A24C 1/30

[52] U.S. Cl. ..... 131/32; 53/211; 131/36; 131/59

[58] Field of Search ..... 53/211, 214; 131/32, 131/33, 34, 35, 36, 37, 59

[56] References Cited

U.S. PATENT DOCUMENTS

| | | | |
|---|---|---|---|
| 693,626 | 2/1802 | Schneekzoth | 131/37 X |
| 829,019 | 8/1866 | Knight | 131/36 X |
| 3,577,293 | 5/1971 | Ritterhoff | 53/211 X |
| 3,794,048 | 2/1974 | Molins et al. | 131/36 X |

FOREIGN PATENT DOCUMENTS

| | | | |
|---|---|---|---|
| 454,712 | 6/1968 | Switzerland | 131/34 |

*Primary Examiner*—Othell M. Simpson
*Assistant Examiner*—John Sipos
*Attorney, Agent, or Firm*—William R. Liberman

[57] ABSTRACT

A machine and method for continuously applying wrappers to a stream of bound cigar bunches.

37 Claims, 39 Drawing Figures

FIG. 29
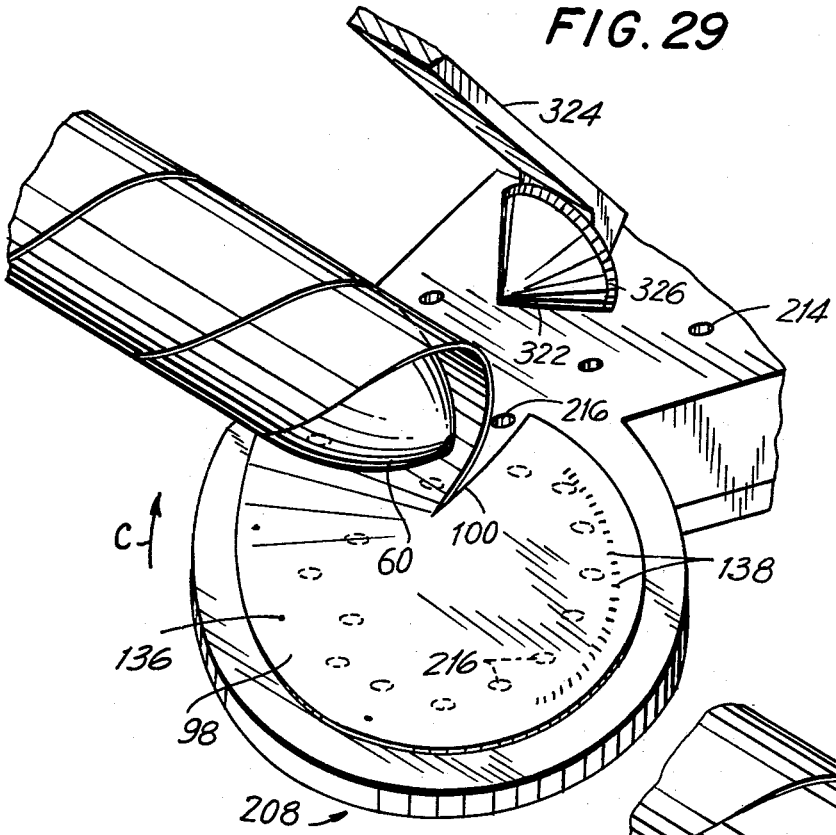
FIG. 30
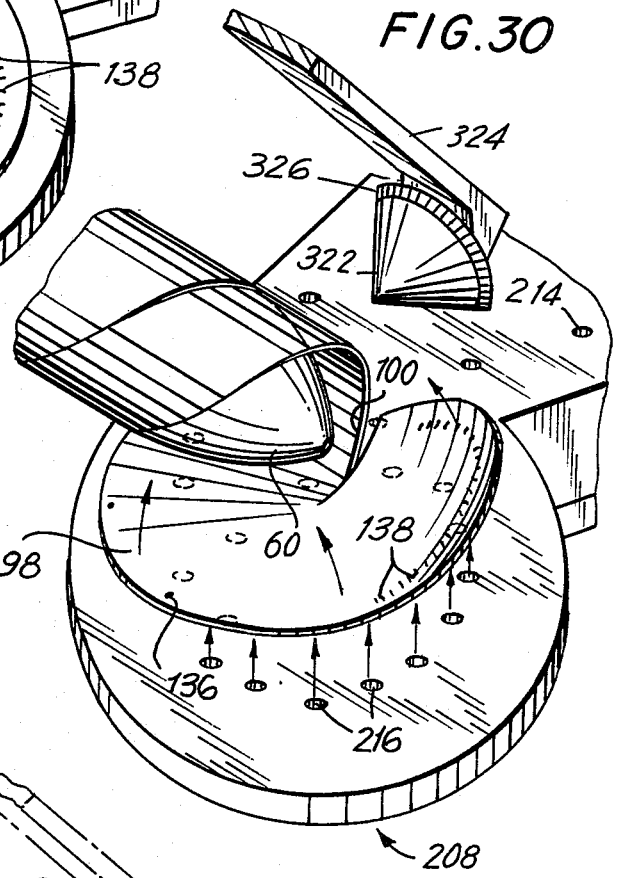
FIG. 31
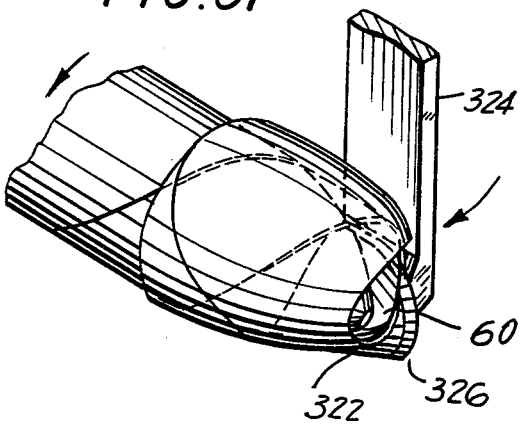
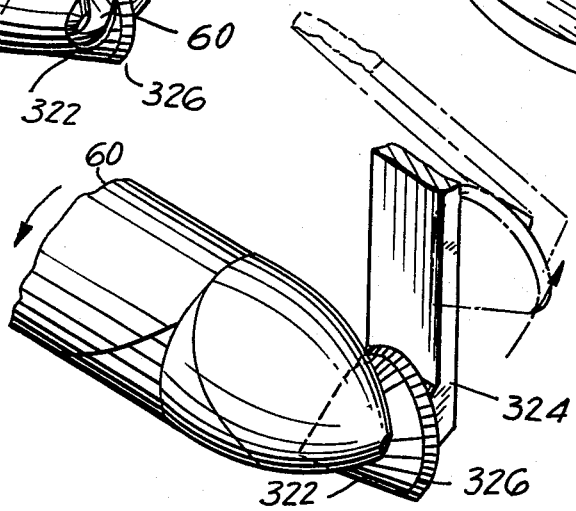
FIG. 32

CIGAR WRAPPING MACHINE AND METHOD

BACKGROUND OF THE INVENTION

1. Field of the Invention

Equipment and a process for wrapping cigars wherein bound bunches are moved continuously in a direction perpendicular to their longitudinal axes while being rotated and while wrappers are moved continuously relative to the bunches and are spirally wrapped about the same and about the rounded tapered ends thereof, the wrappers experiencing changes in position as they are applied to the mouth ends of the bunches so as to be smoothly placed thereon.

2. Description of the Prior Art

Present day commercial cigar wrapping machinery is semiautomatic in operation. An operator running such a machine applies a wrapper to a cutting die surface from which a wrapper carried picks up the die cut wrapper with a controlled vacuum and brings the wrapper to a station where a bound cigar bunch has been mechanically placed. The machine spins the bunch about a fixed axis of rotation while the wrapper carrier manipulates the wrapper so that it is spirally wrapped about the spinning bunch and, toward the end of the wrapping, gyrates the wrapper as it is applied to the tapered mouth end of the bunch. The wrapper carrier moves back and forth between the station where it picks up a wrapper and the station where it applies the wrapper to the spinning bunch. After wrapping, the cigar is mechanically removed from the wrapping station.

Because of the several stop-and-start motions, the shifting of the wrapper, the bunch and the cigar between various locations on an intermittent basis, and the gyrations of the wrapper carrier, production on such machines currently is restricted to about twenty wrapped cigars per minute.

SUMMARY OF THE INVENTION

1. Purposes of the Invention

It is an object of the present invention to provide a cigar wrapping machine and method which overcome the foregoing drawbacks and which render the semiautomatic prior art apparatuses and processes fully automatic and continuous.

It is another object of the invention to provide a machine and method of the type described which wrap cigar bunches with a smooth fluid motion so that substantially higher speeds of production can be obtained.

It is another object of the invention to provide a machine and method of the character described which wrap bunches on the fly including bunches having rounded tapered mouth ends.

It is another object of the invention to provide a machine and method of the character described which wrap twinned fire end coupled bunches with a continuous smooth fluid motion.

It is another object of the invention to provide a machine and method of the character described in which the wrappers are supplied in twinned coupled chevron configuration with adjacent twinned wrappers abutting and nesting whereby to obtain maximum efficiency in the use of a strip of either reconstituted wrapper material or precut natural leaf oriented in a similar manner.

It is another object of the invention to provide a machine and method of the character described wherein the tapered mouth end of a wrapped bunch is shaped to a smooth configuration by use of a header block that engages the rounded tapered end as the wrapper is applies to said end.

It is another object of the invention to provide a machine and method of the character described in which an individual wrapper has a tapered end, i.e. flag, terminating at a curlicue that is applied to the rounded tapered mouth end of a bunch by a complex motion which presents the flag to the bunch at a continuously varying angle, pitch and speed, thus enabling the flag to be formed smoothly and with a minimum of wrinking to and across the rounded end of the bunch.

It is another object of the invention to provide a machine and method of the character described in which suction holds the wrapper to a support as the wrapping is being performed and even during the application of the flag, and further in which at the last moment of the wrapping the suction is changed to pressure to blow the flag up and against the header block and/or stretcher plate to aid in positioning it suitably for smooth wrapping of the tapered mouth end.

It is another object of the invention to provide a machine and method of the character described in which the wrapped cigars have their tapered mouth ends smoothed and knurled and any residual paste is removed in a continuous operation at a location remote from the wrapping station.

It is another object of the invention to provide a machine and method of the character described in which the bunches are rotated about an axis that translates them bodily in a direction transverse to their longitudinal axis as the bunches are spun, and which causes the bunches and associated wrappers to move relative to each other as the wrappers and bunches move from relatively spaced relationship into wrapping relationship and thereafter to experience further relative movement as the wrapping is performed.

It is another object of the invention to provide a machine and method of the character described in which the bunches are maintained in a predetermined spaced relationship as they approach a wrapping station and are released from such relationship as they are wrapped.

It is another object of the invention to provide a machine and method of the character described in which adjacent nested twinned chevron wrappers are transferred to a carrier which subsequently will pick up cigar bunches at the spaced locations, and in which the twinned wrappers have paste applied thereto at proper sites and in a continuous fashion without stopping motion of the wrappers as they approach the bunches and a wrapping station.

It is another object of the invention to provide a machine and method of the character described in which periodically the suction at sundry ports of a support for the cigar bunches and wrappers is reversed to a positive pressure to clean out the ports and the bores leading thereto whereby to ensure efficient operation of the machine and method.

It is another object of the invention to provide a machine and method of the character described in which plural bunches are in the process of being wrapped at the same time, with different bunches in progressively different stages of wrapping.

Other objects of the invention in part will be obvious and in part will be pointed out hereinafter.

2. Brief Description of the Invention

A band, i.e. strip, of reconstituted tobacco composed of particles of tabacco in a conventional binder, or of pieces of natural tobacco glued or cemented end-to-end, is driven continuously to and past a rotary cutter where the band is slit to provide wrappers having tapered flag ends terminating in curlicues. The wrappers are elongated and inclined to their direction of movement toward and past the cutter, the flags being at the trailing ends. Natural leaf outer wrapper may be substituted for the reconstituted tobacco. Natural leaf tobacco would be pre-cut and placed on a tape carrier. The wrappers would be so oriented and spaced that they would be presented to the wrapping head in the same manner as the reconstituted stock. The rotary cutter would not be required if die cuts wrappers are provided on a tape. Adjacent wrappers in long-edge to long-edge contiguity are moved without stopping to a carrier drum that is turning continuously about a fixed horizontal axis. The carrier drum has suction ports on its cylindrical surface which are sited to pick up alternate (every other) wrappers without changing their orientation. The remaining wrappers are transported to another wrapping mechanism. The wrappers on the carrier drum are spaced apart circumferentially by the width of one wrapper and are continuously moved from their point of pick-up toward and past a rotary pasting station where paste is applied to predetermined zones of the wrappers.

The drum carries pasted wrappers to a rotary bunch transfer station where bunches are applied at spaced intervals as the carrier drum turns. The bunches are placed on the carrier drum with their longitudinal axes parallel to the axis of rotation of the drum. The drum moves the bunches toward a wrapping zone which extends circumferentially over a substantial portion of the drum. As they are transferred, the bunches lie angularly across the wrappers held to the drum. Each bunch is located across the leading tip of its associated wrapper which is to be spiraled around it. After placement on the drum, each bunch and its associated wrapper are moved with the drum towards the wrapping station.

As each bunch and its wrapper enter the wrapping station the bunch is rotated about its longitudinal axis and at the same time the wrapper and the bunch experience relative movement in a direction circumferentially with respect to the drum whereby the wrapper spirals about the rotating bunch. During wrapping, the wrapper gradually is released from the drum. As the wrapper winds about the bunch, it progresses helically from one end to the other with a sight overlap; in the case of a pair of fire end twinned coupled bunches, the wrapper progresses from the center toward the mouth ends.

For smooth wrapping of the non-cylindrical, namely, tapering, hemi-ovoid configuration of the mouth end of a bunch, the terminal portion of the wrapper is shaped as a flag that is tapered and ends in a curlicue, the presentation of the flag to the bunch varying angularly and in speed near the end of the wrapping cycle. In order to effect this variation, the carrier drum has for each wrapper a flag carrier on which the flag end of the wrapper is supported by suction. The flag carrier is so mounted and actuated that, as the flag is being wrapped on the mouth end of a bunch, the flag experiences a compound movement relative to the drum which continuously changes the angle and speed at which the flag is presented to this end of the spinning bunch. Moreover, at the very end of the wrapping of the flag on the bunch, the suction on the flag is reversed to pressure whereby to force the curlicue toward the mounth end of the bunch. The curlicue, as it is forced up, crosses the tip of the mouth end and closes the same.

The presentation of the flag to the spinning bunch as the flag is wraped about the mouth end is assisted by providing a header block over the forming surface of which the flag is passed near the end of the wrapping operation and by which the flag is guided onto and thereafter molded onto the mouth end of the spinning bunch. The header block lightly presses against the wrapped mouth end of the bunch to impart a finished shape thereto and to perform a preliminary smoothing thereof.

Optionally, at the very end of the wrapping of the mouth end, a conical spinner is approached to the mouth end and rides thereon to finish the shaping of this end of the cigar.

As the wrapping is taking place, the bunch being wrapped traverses an arc lagging behind the speed of rotation of the drum, the differential in speed causing the spinning of the bunch. When wrapping is completed the cigars are discharged from the wrapping station and transferred to a smoothing station at which the mouth ends of the cigar are subjected to the action of rotating skeleton cups that move bodily with the cigars and spin around and in contact with the mouth ends thereof to remove any traces of paste and any irregularities in the mouth ends. By having the cups move bodily with the cigars as they are smoothed, the smoothing operation, like the wrapping operation, is rendered continuous. If effect, the wrapping and the smoothing are, so to speak, "flying" operations performe first upon a translating bunch without stopping it and then upon a translating cigar without stopping it.

Finally, if the bunch being wrapped is a double bunch with the bunches coupled at the fire end, the coupled cigars are slit apart or a small segment between cigars is removed whereby to separate the cigars which thereupon are ready for banding, if any, and packaging, e.g. in sleeves, tubes and/or boxes.

In one form of the invention the wrappers are single, i.e. each wrapper is associated with a single cigar. In another form of he invention the cigars are twinned at their fire ends and the wrappers are twinned at the ends thereof corresponding to such fire ends, twinned cigars being concurrently wrapped and each pair of twinned wrappers being in the configuration of a chevron.

The bunches can be spun about their longitudinal axes and at the same time angularly moved with respect to the circumferential surface of the carrier drum in various manners.

The machine may include only a single wrapping head for single bunches, or a single wrapping head for twinned bunches, or successive wrapping heads, e.g. two, for single bunches or the twinned bunches, the highest production speeds being achieved when double wrapping heads for twinned bunches are employed. Four hundred cirgars wrapped per minute is well within the capability of a two-headed twinned-bunch wrapping machine.

The invention consists in the features of construction, combination of elements, arrangement of parts and series of steps which will be exemplified in the methods and apparatuses hereinafter described and of which the scope of application wil be indicated in the appended claims.

BRIEF DESCRIPTION OF THE DRAWINGS

In the accompanying drawings in which are shown various possible embodiments of the invention:

FIG. 29 is an enlarged fragmentary perspective view of the end of the flag being wrapped about the mouth end of the bunch with the cone roller inoperative;

FIG. 30 is a view similar to FIG. 29, but illustrating the end of the flag being popped away from the flag carrier, the cone still being inoperative;

FIG. 31 is a view similar to FIGS. 29 and 30 but illustrating the location and shape of the end of the flag as initial contact therewith is made by the cone roller which now is operative;

FIG. 32 is a view similar to FIG. 31, but illustrating the configuration of the wrapper on the mouth end of the bunch after the cone roller has completed it operation;

PREFERRED EMBODIMENTS OF THE INVENTION

GENERAL DESCRIPTION

Referring now in detail to the drawings, and more particularly to FIGS. 1 - 32, a wrapping machine 50 is illustrated which, for the sake of simplicity, has been shown and will be described as a machine with a single wrapping head, although it is designed to be used with a following second wrapping head. It is also a machine that is shown and will be described in connection with wrappers for single bunches as distinguished from coupled (twinned) bunches. A machine for wrapping coupled bunches will be illustrated and described subsequently. But to understand the basic operation of the present invention without its various refinements that increase its speed of production and, therefore, are quite desirable, it suffices at this stage to illustrate and describe the aforesaid single wrapping head for single bunches.

Figure 1:
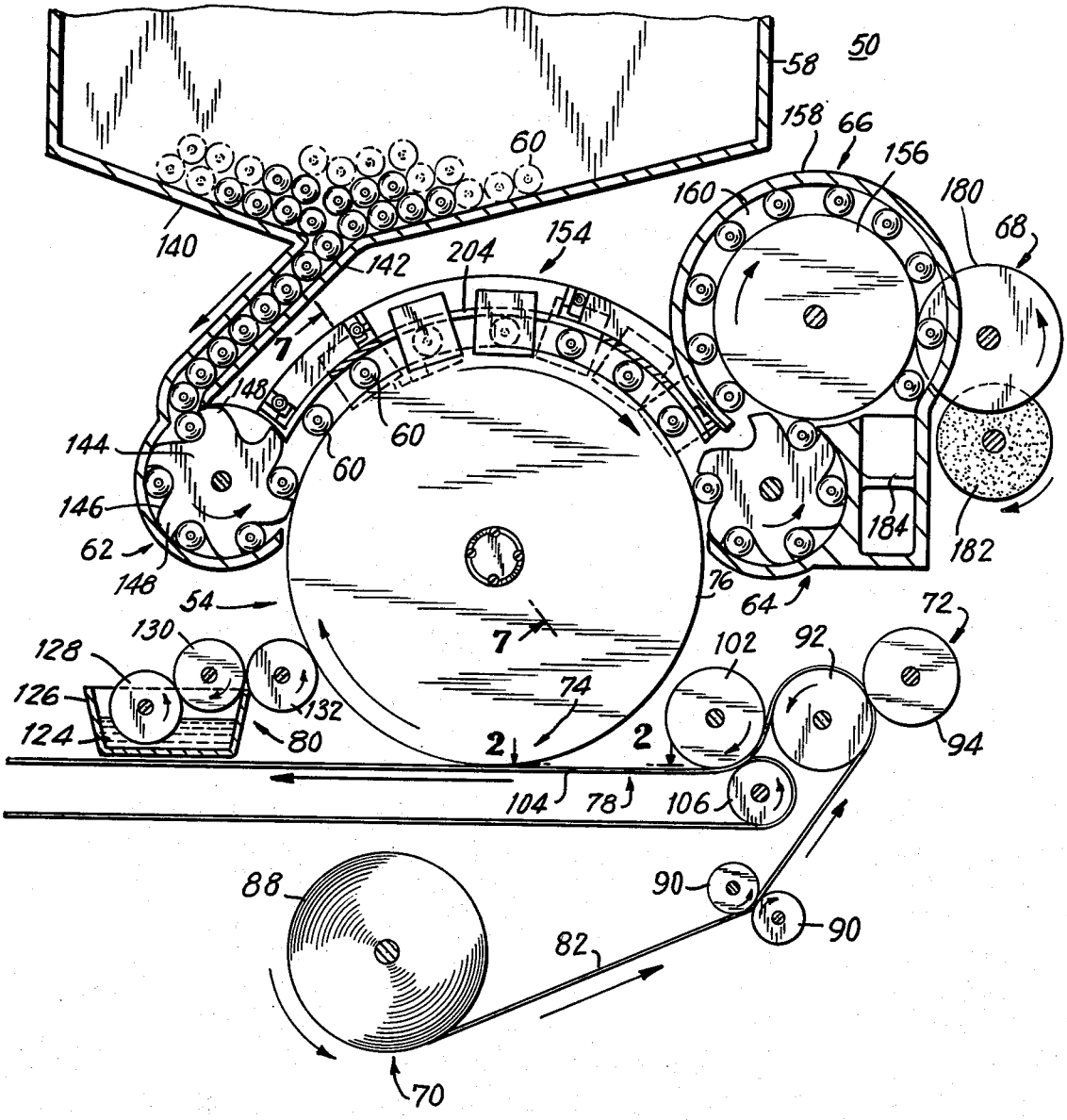
FIG. 1 is a vertical fragmentary sectional view of a single flying wrapping head for wrapping single bunches with single wrappers on the fly, the same representing a simple form of the present invention; the single head of FIG. 1 is intended to be used in conjunction with a following head, but a single head has been illustrated to simplify the explanation of the invention, plural wrapping heads being illustrated subsequently.

The wrapping machine 50 includes a vertical mounting plate 52 (see FIG. 7) which, for clarity, has been omitted from FIG. 1, on which a wrapping head 54 and associated equipment, to be described, are supported. On the back surface of the wrapping plate drive means is provided (not shown) which, among other things, rotates a sleeve 56 journaled in the plate 52. Associated with the wrapping head 54 is a magazine 58 in which single bunches 60 are contained. Also associated with the wrapping head is an input bunch transport, i.e. feed means 62, an output cigar transport, i.e. delivery means 64, a flying mouth end cleaning and smoothing means 66, a fire end trimming means 68, a source 70 of wrapper material, e.g. a strip of reconstituted tobacco, a slitting means 72 for subdividing the wrapper strip into individual contiguous wrappers, a wrapper pick up station 74 at which alternative wrappers formed at the slitting means are picked up by a wrapper carrier in the form of a carrier drum 76, a wrapper transport means 78 to which wrappers are delivered from the slitting means 72 and from which alternate wrappers are picked up at the pick up station 74 after which the remaining wrappers are carried to another wrapping head, and a pasting station 80 located adjacent the circumference of the carrier drum 76 between the wrapper pick up station 74 and the input bunch transport means 62.

WRAPPER FORMATION

The source 70 of the wrapper strip 82 is a sheet of reconstituted tobacco, the make up of such sheet being well known to the art. The sheet includes particulate natural tobacco which has been attrited from natural leaf material and embedded in a matrix of smokable material. The strip is of proper width for use with the wrapping head 54, the width being such as to accommodate the effective breadth of inclined wrappers 84 (see FIG. 2). Preferably, the strip is slightly wider than the effective breadth which is perpendicular to the length of a series of individual wrappers so that when wrappers are separated from the strip a skeleton web 86 will remain which can be drawn off the machine 50, as will be appreciated from examination of FIG. 2. Reconstituted tobacco is preferred if the same is acceptable as a wrapper for a finished cigar, as it conventionally is for inexpensive cigars, inasmuch as wrappers of reconstituted tobacco are uniform in consistency, strength, dimension and appearance, making it easier to design a machine to handle the same in high-speed mass production. However, the supply roll may be made up of joined or carried pieces of natural tobacco.

The strip conveniently is provided in the form of a supply roll 88 for which the strip is unwound. The supply roll is journaled on a shaft extending from the mounting plate 52. The wrapper strip 82 is drawn off the roll 88 by a pair of driven feed rolls 90 from which it is led to an anvil roller 92. A slitting roller 94 has slitting blades (not shown) riding on the wrapper strip trained about the anvil roller. The configuration of the slitting blades is such that separation lines are cut into the wrapper strip; these line define successive contiguous wrappers 84 of the configuration illustrated in FIG. 2. Such configuration constitutes a band of uniform width extending diagonally across the wrapper strip 82 with each band having a leading apex 96 and a trailing flag 98. One end of the band, the end opposite to the flag, forms in conjunction with the corresponding ends of the other bands a straight line near a longitudinal edge of the strip 82. The flags 98 are spaced from one another. The shape of the flags is not unique to the present invention. It has been used in conjunction with semi-automatic wrapping equipment.

Figure 2:
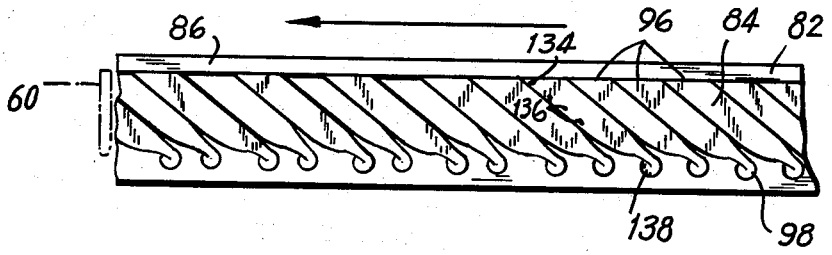
FIG. 2 is a top plan view of the wrapper belt conveyor, alternate wrappers being picked up by the single head of FIG. 1 and the balance of the wrappers being transported to a following in-line wrapping head for single bunches.
Figure 20:
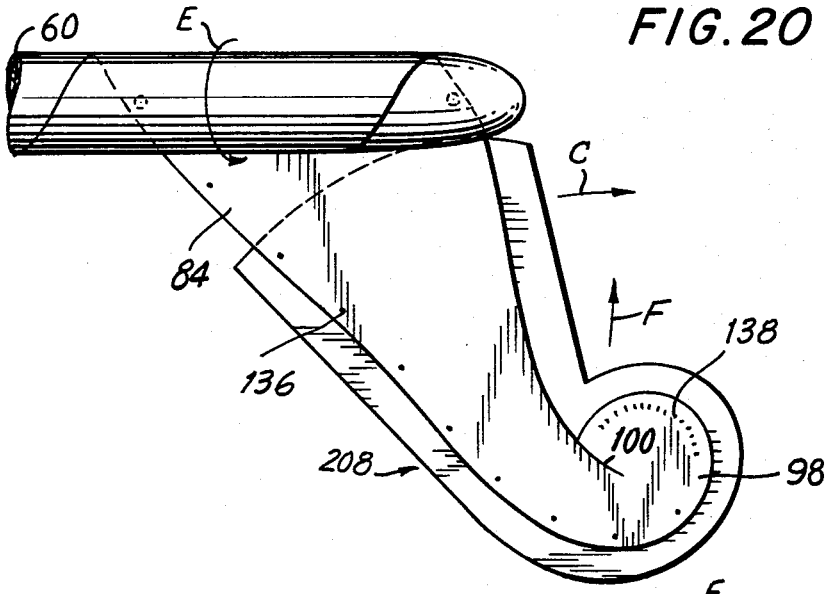
FIG. 20 is a plan view of a bunch that is fully wrapped except for its rounded tapered mouth end, and showing the flag carrier in its starting position.

The flag is in the form of a tapered end terminating at a curlicue the configuration of which is generally indicated in FIG. 2 and which is shown to greater detail in FIG. 20. The curlicue has a generally circular outline with a retroverted tail. The terminal edge of the tail abuts against an edge of the flag to provide a separating slit 100 the purpose of which will be mentioned subsequently.

The anvil roller 92 has a foraminous surface with an internal sub-atmospheric pressure so that, after the wrappers are formed by a slitting operation, they and the web adhere to the anvil roller.

WRAPPER HANDLING

After leaving the anvil roller 92, the wrapper strip, which now has successive contiguous wrappers formed therein by slitting, is led under a wrapper transfer roller 102 which accepts the wrapper strip with its wrappers and transfers them onto a belt 104 constituting the wrapper transport means 78. The wrapper transfer roller 102 has a foraminous surface and is provided with an internal sub-atmospheric suction means in the region where the transfer roller is adjacent the anvil roller whereby to assist in transferring the wrapper strip with its included wrappers onto the roller 102.

The roller 102 rides on a belt 104 which is foraminous and travels over a suction box near an idler or drive roller 106, whereby to hold to the upper surface of the belt the wrapper strip 82 and the wrappers 84 forming a part thereof. The vacuum belt 104 is trained about a pair of parallel rollers of which 106 is one and the other roller is not shown. These rollers so position the upper reach of the belt that said reach travels beneath and essentially rides on the carrier drum 76 at the wrapper pick up station 74.

The carrier drum is hollow (see FIG. 7, for example) and can be cast or molded. The substantially cylindrical surface of the carrier drum is provided with sets of wrapper holding outlet ports 112 (see FIG. 13). Each set of said ports forms a pattern substantially in the shape of a wrapper, except for the flag, the pattern being slightly smaller than the wrapper so that it will be spaced a short distance inwardly from the periphery of the wrapper, again except for the flag. Each set of such ports 112 is so positioned on the carrier drum that the set will be in registry with a wrapper and the next set with an alternate following wrapper (the next but one) in the wrapper strip 82 transported by the belt 104 and located at the wrapper pick up station.

The linear speed of the belt 104 is the same as the linear speed of the cylindrical surface of the carrier drum 76, and both the belt and the carrier drum are driven from the same rotary power source, the belt being synchronized with the drum so that a wrapper in the skeleton web 86 is in registry with a set of ports 112 when the belt is closest to the carrier drum, namely, at the wrapper pick up station 74.

In the machine 50 here being described a set of ports will be in registry with a given wrapper in the skeleton web at the pick up station and the next series of ports subsequently will be in registry with, not the next wrapper in the strip, but, the wrapper after the next wrapper, whereby alternate wrapper strips will be picked up by successive series of ports 112. This best is appreciated by inspection of FIG. 2 wherein the wrappers at the right-hand side of the strip are shown as they appear in the skeleton web prior to the wrapper pick up station, and the wrappers at the left-hand side of the strip are shown in the web 86 beyond the pick up station, alternate wrappers having been transferred at said station 74 from the belt 104 to the carrier drum.

The carrier drum is secured to a circular plate 114 (see FIG. 7) that is fixed to a sleeve 116. Said sleeve concentrically ensheathes the sleeve 56 to which it is fast. The sleeve 56 extends through an opening 120 in the mounting plate 52, being connected at the rear of said plate to a rotary drive (not shown) which also actuates the belt 104 and other moving components of the wrapping machine 50. The sleeve 56 is rotatably mounted on a dead (stationary) horizontal shaft 122 that extends from a fixed position (not shown) at the rear of the plate 122 forwardly through the opening 120 a sufficient distance to mount the sleeve 56 and another member hereinafter to be described.

Suitable means, shortly to be detailed, is included to supply sub-atmospheric pressure, i.e. suction, to the outlet ports 112. Initially, all the ports have suction applied thereto at or shortly prior to the time that the ports enter the wrapper pick up station, the suction being maintained until the wrapper held by a set of ports is supplied to a bunch, the suction then being progressively released as the wrappers are spiraled about a bunch.

WRAPPER PASTING

The pasting station 80 applies a mild water-based glue, as a tragacanth-based gum, or a CMC glue, spotted on the wrappers supported by the carrier drum and moving with the drum away from the wrapper pick up station 74. A liquid or viscous glue 124 is contained in a tray 126 having a horizontal pick up roller 128 mounted so that a portion thereof is below the surface of the glue. Riding on the pick up roller 128 above the surface of the glue in the tray is a horizontal spreading roller 130. In contact with the spreading roller is a horizontal applicator roller 132. The applicator roller is in a light kissing contact with the cylindrical surface of the carrier drum. At least the roller 132 is driven by the same source that drives the carrier drum. The roller 132 turns at such a speed that its cylindrical surface has the same linear speed as the cylindrical surface of the carrier drum. The roller 130 can be driven by gears in engagement with the roller 132. Likewise, the roller 128 can be driven by gears engaged with the roller 130. The roller 128 picks up a thin film of glue from the tray 124 and transfers it to the roller 130 from which it is applied to the roller 132.

The roller 132 has a raised pattern on its surface to which glue is applied by the roller 130. This pattern corresponds to the desired sites of application of glue to the wrappers 84. Specific sites of application of glue are shown in FIG. 2. These may vary according to the designers of the particular cigars being made at any given time. Typical sites of application are a dot 134 which is at the leading tip 96 of a wrapper, a few dots 136 or even a fine line of dots along the leading edge of a wrapper, and an arcuate series of closely spaced dots 138 (see also FIG. 29) near the periphery of the trailing edge of the flag 98. The dot 134 makes the initial adhesive engagement between a wrapper and its associated bunch, the dots 136 make subsequent engagement between the leading edge of a wrapper and its associated bunch or the rear edge of a preceding convolution of the wrapper about the bunch, and the dots 138 effect adhesive engagement between the curlicue and previously applied portions of the wrapper at the rounded tapered mouth end of the cigar. It should be noted that the patterned applicator roller 132 has the raised pattern thereon which carries glue from the roller 130 synchronized with wrappers being carried by the carrier drum to, through and beyond the pasting station so that the applicator places glue at the desired sites on successive wrappers.

BUNCH FEED

The magazine 58 constitutes a hopper in which a considerable number of bunches are disposed in orderly array, being horizontally oriented and supported on a bottom wall 140 that tapers to a discharge chute 142 which leads cigars in single file and still in horizontal orientation to the bunch input transport means 62. Said means 62 constitutes a star wheel 144 mounted to turn about a horizontal axis (see FIGS. 1, 4, 5 and 6). The star wheel is of generally cylindrical external configuration and is provided with a series of J-shaped sockets 146, the long leg of the J leading and the short leg trailing in the direction of rotation of the drum 144. Said drum turns in such direction that its surface travel matches the direction of travel of the surface of the carrier drum 76 at the zone where the bunches are delivered to the drum. The speed of the two drums are synchronizingly matched and the location of the sockets 146 are matched with the leading tips 96 of the wrappers 84 on the drum. Each socket is just large enough to receive one bunch (see FIG. 1) from the terminal end of the discharge chute 142 whereby, each time that a socket of the continuously turning star wheel 144 passes beneath the terminal end of the discharge chute, a single bunch will fall into the socket and the following bunch in the chute will be held back by the bunch in the socket until the portion of the drum, namely, a tooth 148 following the just-filled socket, passes beneath the terminal end of the chute to retain said following bunch until the next socket is aligned with the chute.

Figure 6:
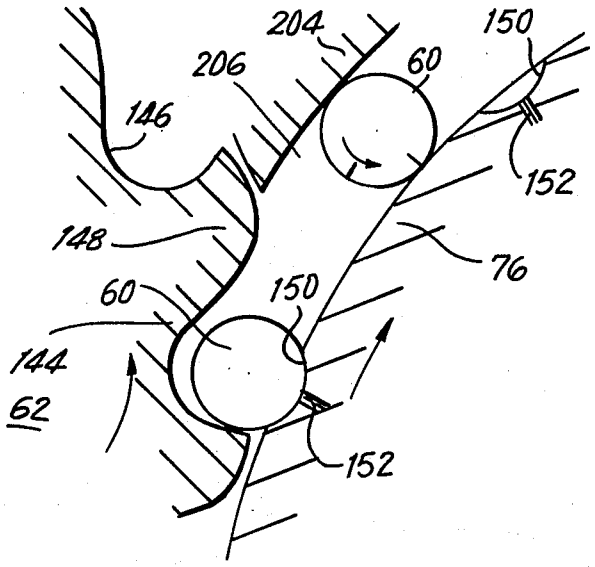
FIGS. 5 and 6 are views similar to FIG. 4 but at slightly later intervals, FIG. 5 illustrating the relative position of the parts after wrapping of the bunches has started, and FIG. 6 showing the bunch after wrapping has proceeded further and while a subsequent bunch is being advanced to the start of the wrapping station.
Figure 4:
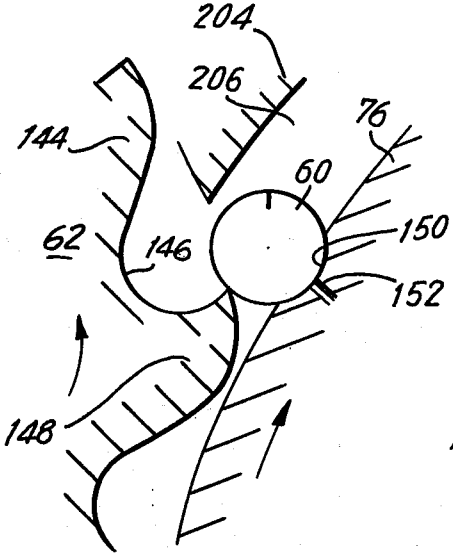
FIG. 4 is a highly enlarged fragmentary vertical sectional view of a segment of the wrapping head at the transfer station where bunches are transported from a star wheel to the carrier drum prior to wrapping.

The sockets transport bunches to the carrier drum 76, the feed drum 144 being so located that its circumference, as defined by the tips of the teeth 148, sweeps past the circumference of the drum to place the bunches in the sockets thereon. As a bunch is deposited on the carrier drum it will be nudged in the direction of travel of the carrier drum by the apex of the tooth 148 following the socket from which the bunch is being discharged. This nudging action is illustrated in FIG. 4. The deposit of a bunch on the drum just prior to the nudging action is illustrated in FIGS. 1 and 6.

The cylindrical surface of the carrier drum is provided with a plurality of shallow bunch receiving grooves 150, there being one groove for each set of outlet suction ports 112 and each wrapper 84 held by such suction ports. The grooves 150 are parallel to the axis of rotation of the carrier drum and each groove crosses the point where the leading portion 96 of the wrapper is located. Specifically, each groove is just below the glue dot 134. The angular orientation of the sockets 146 in the feed drum 144 is such that one bunch will be deposited in each groove 150 as that groove reaches the input transport means 62. Thus, groove after groove on the drum will have a bunch deposited therein.

All the bunches have similar endwise alignment which is such in the machine 50 that the mouth end of every bunch points away from the mounting plate 52.

Suction outlet ports 152 are provided at spaced points along the length of the grooves 150. These ports have suction applied thereto prior to the time that a groove reaches the input transport means for the bunches and, as shown, suction is applied to these ports at the same time that it is applied to the suction outlet ports 112 for the associated wrapper. The suction in the grooves holds the bunches on the carrier drum in the short span between the input transport means and a wrapping station 154. The details of the wrapping station will be described later.

CIGAR HANDLING

After leaving the wrapping station, the cigars are delivered to the output transport means 64, the structure of which will not be described inasmuch as it is duplicative of the structure of the input transport means. The output transport means delivers cigars one at a time to the cleaning and smoothing flying means 66 through which the cigars move in mutually spaced relationship in a continuous manner.

The means 66 includes a horizontal roller 156 which turns within a generally cylindrical casing 158 (see FIGS. 1 and 3), there being an annular space 160 between the circumference of the roller 156 and the internal cylindrical surface of the casing 158. At the point of entry to the means 66, the cigars are deposited in horizontal orientation in the annular space 160 which is slightly less in width than the diameter of the cigar. Thereby cigars are lightly squeezed between the roller 156 and the interior of the casing 158. Inasmuch as the roller is turning, successive cigars will be advanced from the inlet of the casing to the outlet therefrom while they roll on the roller and on the casing. The turning movement of the cigars about their longitudinal axes in the means 66 is of no particular consequence. However, the continuous movement of the cigars from their points of entry to the means 66 to their point of exit therefrom is consonant with the continuous movement of the bunches and wrappers through the machine; that is to say, the wrappers move continuously from the time they are cut until the time they are wrapped about cigars and, similarly, the bunches from the input means to the output means move continuously through the machine, all operations being performed upon and by the moving wrappers and bunches whereby the moving parts are not actuated intermittently nor moved by hand with a consequent slow-down of operations.

Figure 3:
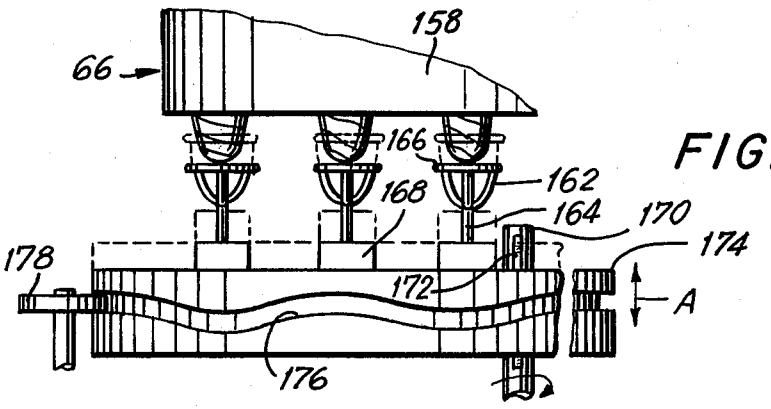
FIG. 3 is a fragmentary top plan view of a postwrapping flying, smoothing mechanism which constitutes a portion of the machine illustrated in FIG. 1.
Figure 7:
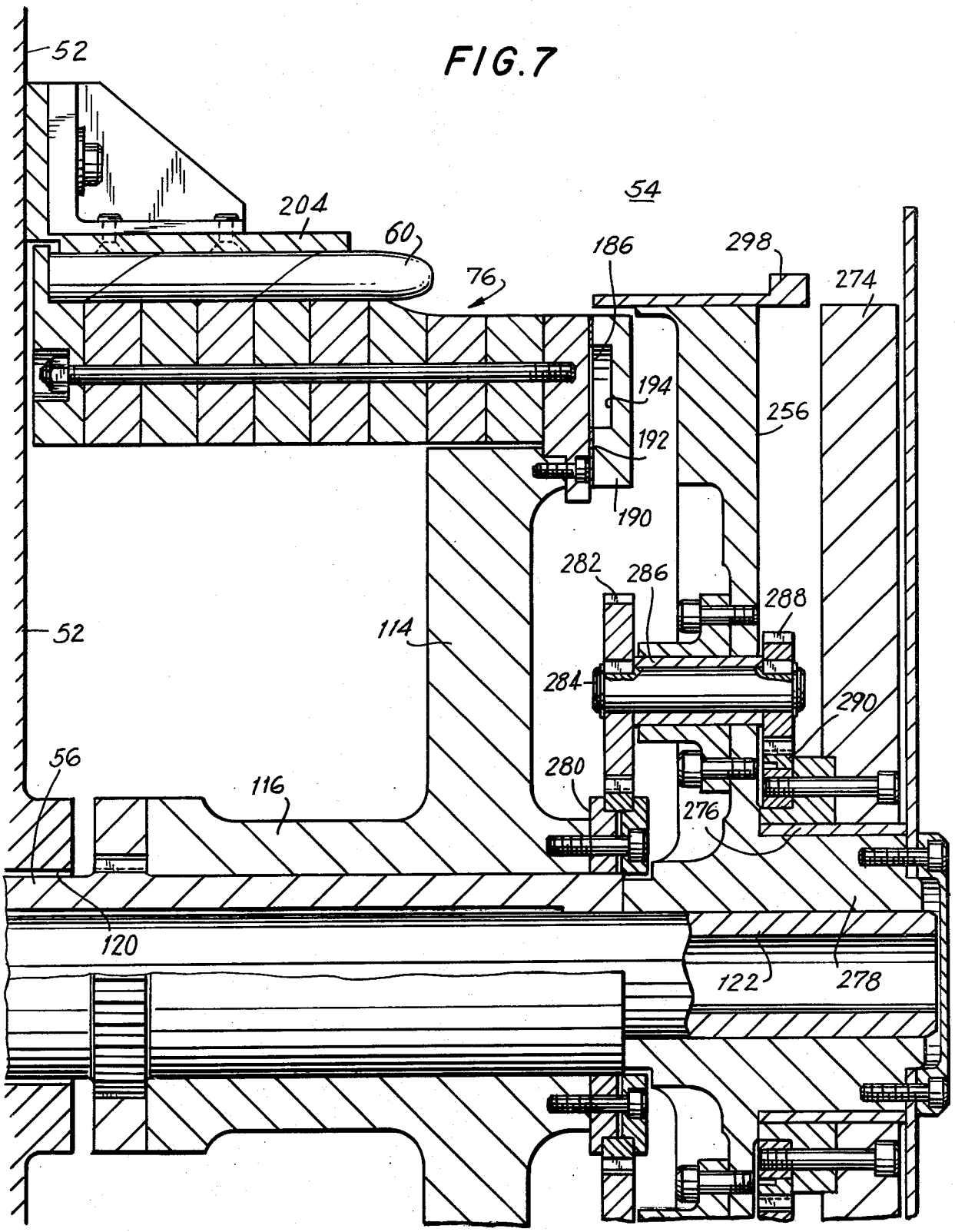
FIG. 7 is an enlarged axial fragmentary auxiliary view taken substantially along the line 7—7 of FIG. 1 and illustrating the stationary rolling shoe, the vacuum ring, the fixed cam plate, the ridge cam and the mounting plate that supports the header blocks.
Figure 9:
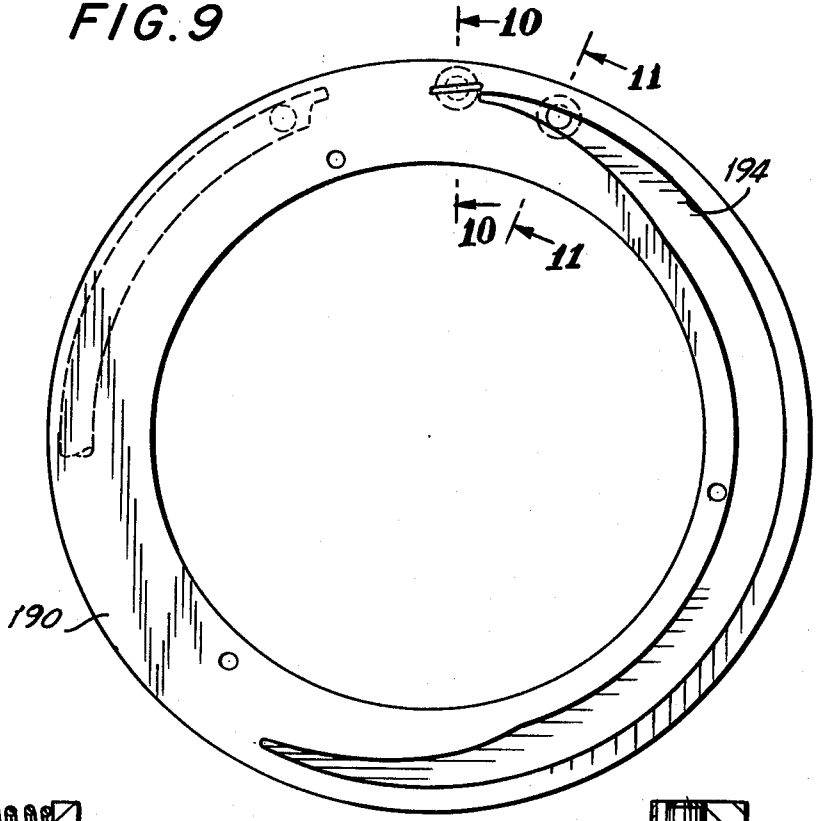
FIG. 9 is a rear view of the vacuum ring, showing the vacuum chamber port therein.
Figure 11:
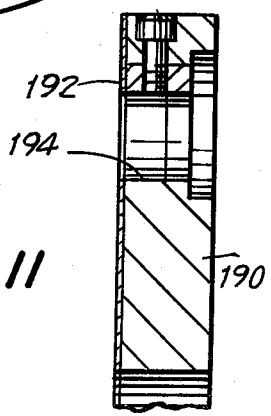
FIGS. 10 and 11 are enlarged fragmentary sectional views taken substantially along the lines 10—10, 11—11 of FIG. 9 and illustrating pressure and vacuum connections respectively.
Figure 10:
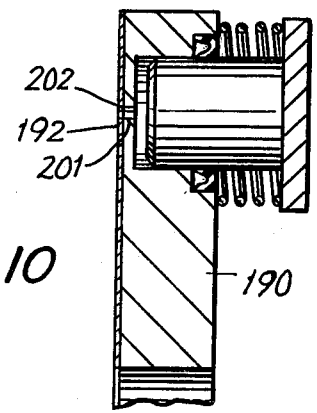
Figure 8:
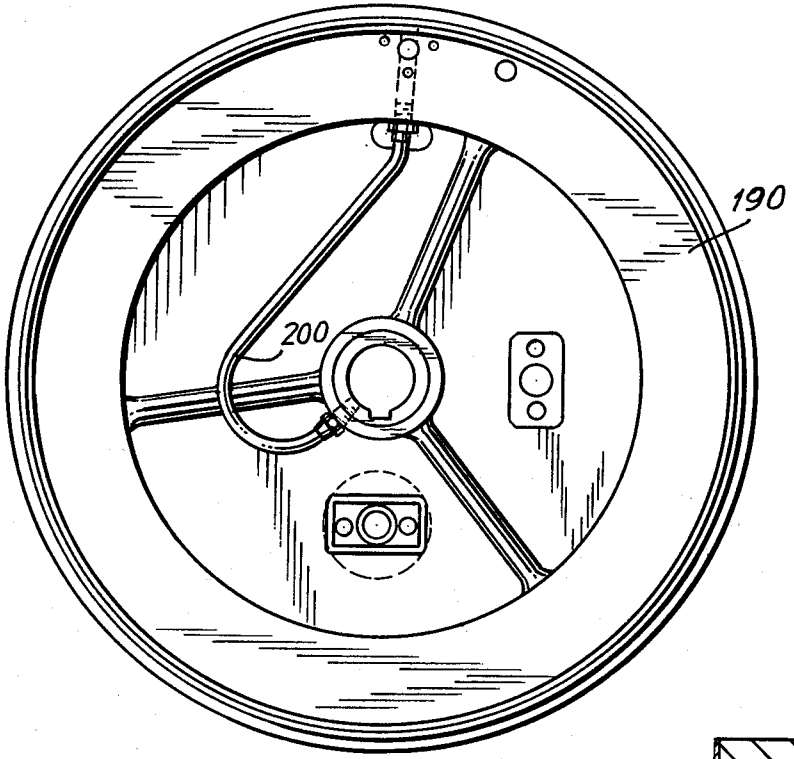
FIG. 8 is a front view of the vacuum ring and associated air line.

In the cleaning and smoothing flying means 66 the tapered mouth ends of the wrapped cigars protrude beyond the casing 158, as best can be seen in FIG. 3. To perform the desired smoothing and cleaning action, a circular set of spaced skeleton cups 162 is provided, each of which has an open mouth and an internal configuration shaped to match the desired tapered configuration of the specific form of mouth end of the cigars being made. Each cup consists of a few, e.g., three or four, ribs running from a spindle 164 to a rim 166. The open ends of the cups face the cigars riding around the cleaning and smoothing means 66 between the roller 156 and the casing 158. The spindles are secured in separate chucks 168 which are rotated by a common drive (not shown) that is powered by a shaft 170 through a key riding in a keyway 172 in said shaft. The sundry chucks are supported by a ring 174 that is mounted for rotation about an axis concentric with the axis of rotation of the roller 156. The ring 174 rotates at a speed which matches the speed of rotation of the cigar around the roller 146, this being a fraction of the speed of rotation of the roller 156. The spindles 164 and cups 162 are aligned with the ends of the cigar moving through the means 66, such synchronization being obtained by the means for rotating the ring 174, which is driven by the same means that turns the carrier drum and the other various moving parts of the wrapping machine 50. The ring 174 is mounted for movement axially of its axis of rotation in a direction indicated by the arrow A (see FIG. 3).

A circumferential cam track 176 is formed on the circumference of the ring 174. This track receives a stationary follower 178. By virtue of the co-action between the follower 178 and the track 176, the ring will move toward and away from the casing 158 from a remote position shown in solid lines in FIG. 3 to an engaged position shown in dotted lines in the same figure. In the remote position the rims 166 of the cups 162 are clear of the mouth ends of the cigars and thus permit the output transport means 64 to feed fresh cigars one at a time into the means 66. In the engaged position of the cups they ride lightly on the mouth ends of the wrapped cigars, enabling the edges of the ribs 162 to turn rapidly about these ends so as to smooth them as well as to remove from them any extraneous material such, for instance, as tiny particles of glue. The cups are in their remote position at the time that cigars are delivered to and discharged from the means 66. While the cups are in engaged position, the cups, in addition to rotating about their individual axes defined by their chucks and spindles, rotate about the axis of the roller 156 at the same speed at which the cigars travel about this axis whereby a "flying" operation is obtained.

The fire ends of the bunches and of the wrapped cigars are uneven, and to give them a neat appearance the trimming means 68 is provided. Said trimming means constitutes a cutting disc 180 which is turned at high speed by any suitable driving means, not necessarily being synchronized with the carrier drum, the pasting station, the input and output transport means, the wrapping means and the cleaning and smoothing means. Said cutting disc turns about a horizontal axis and has a portion thereof located in the path of travel on the means 66 of the ends of the wrapped cigars remote from the mouth ends. As the fire ends of the wrapped cigars pass the cutting disc, the cigars are moving in a general direction perpendicular to the plane of the disc, the revolving of the cigars about their individual longitudinal axes having no effect on the trimming performance of the cutting disc 180 which neatly crops a small fraction of the lengths of the cigars from the fire ends to leave clean perpendicular fire end surfaces. The fire ends project beyond the roller 156 and may project beyond the casing 158 to permit an unobstructed operation of the cutting disc, or, if desired, the cutting disc may enter a slot in the casing 158. A keen cutting edge is maintained on the cutting disc 180 by a driven honing wheel 182 which rides lightly on a portion of the cutting periphery of said disc.

The cigars drop from the discharge end of the means 66 onto a chute 184 from which they slide to the exit of the wrapping machine 50.

BUNCH WRAPPING

Returning now to the wrapping station 154, it is desirable, before commencing a detailed description thereof, to consider the details of the suction arrangement for holding the wrappers and bunches and of subsequently releasing the cams, desirably at proper times. For example, the bunches must be held to the carrier drum by suction at least from the time that they are received from the input transport means 62 to the time that they are engaged in the wrapper station 54. In other words, the suction means associated with the carrier drum maintains positional control of the bunches between their positional control by the input transport means and their positional control at the wrapping station. The positional control during such transfer is needed because the bunches at this time are being raised, so that if control should not be maintained the bunches would fall and synchronism of the bunches with mechanisms at the wrapping station would not be maintained. However, at the output from the wrapping station where the cigars are discharged to the output transport means 64 positional control is not needed since the cigars simply will drop one after another into successive sockets in the star drum for the output transport means.

Similarly, as to the wrappers, positional control is required from the wrapper pick up station 74 to and past the pasting station 80, to and past the input bunch transport means 62, and far enough into the wrapper station to prevent any part of a wrapper from being free to change its position except for a wrapping operation. Desirably, at the wrapping station the suction maintains positional control of the wrappers, progressively releasing successive portions of the wrappers as they are wrapped.

Figure 12:
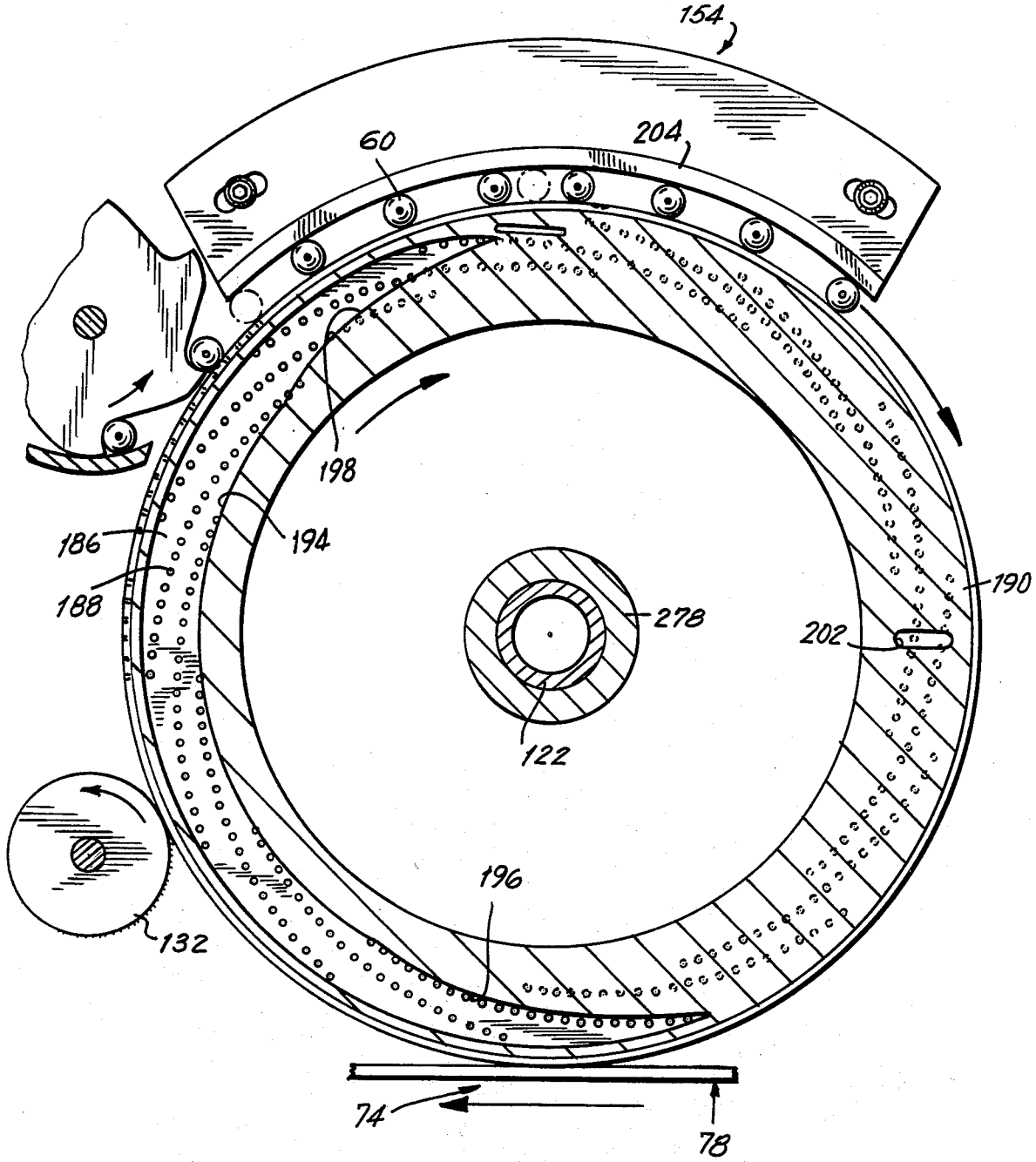
FIG. 12 is an enlarged sectional view through the vacuum ring showing the vacuum chamber port and its relationship to the inlet ports in the drum for vacuum and pressure on the wrappers and bunches.

In order to effect the foregoing suction control of the bunches and wrappers, the outer vertical face 186 (see FIG. 12) of the carrier drum 76 remote from the mounting plate is provided with suction inlet ports 188 arranged in sets. As shown in FIG. 12, each set is, for convenience, in the form of an arcuate line running from near the outer periphery of the face 186 to near the inner periphery of such face. Different ones of a set of said inlet ports 188 are connected by different bores (not shown) to different ones of said wrapper holding suction outlet ports 122. Another one of the inlet ports 188 is connected to a manifold for all of the suction outlet ports 152 for a groove that holds a bunch associated with the wrapper holder ports 112 of that set. Another group of inlet ports in each set is connected by bores, hereinafter to be described, to further suction ports, hereinafter to be described, that hold the flag of the wrapper associated with the wrapper held by the ports 112.

The end face 186 of the drum has a matching face of an annular stationary vacuum ring 190 riding thereon with a thin, flat seal 192 (FIGS. 10 and 11) interposed therebetween. The vacuum ring 190 is formed with a vacuum chamber port 194 (FIGS. 9, 11 and 12) therein that is connected to a source of sub-atmospheric pressure (not shown). The port 194 is of arcuate shape and extends over approximately 180° (the arc of movement of a wrapper from the pick-up station 74 to about the middle of the wrapping station 154) of the annular vacuum ring 190. Over a substantial portion of its central length the port is of uniform radial width, this being slightly greater than the radial width of a set of inlet ports 188. Each set of inlet ports is arranged in an arc extending from a smaller to a larger diameter (FIG. 12), the sets of ports, considered all together, having the appearance of a group of curved fan blades, i.e. each set of ports defines an arc and each arc is approximately parallel to and diverges slightly outwardly from its adjacent arcs. The drum 76 turns clockwise with respect to the stationary vacuum ring 190 as seen in FIG. 12. The tapered trailing edge 196 of the port 194 has a curvature conforming to the curvature of the sets of inlet ports. The tapered leading edge 198 also is curved.

Due to the aforesaid curvature of the trailing edge 196, as the drum turns and brings successive sets of ports 188 past this edge, all of the ports of each set as they cross the edge will be exposed simultaneously to the sub-atmospheric pressure in the port 194 so that at this moment suction is applied to the associated set of wrapper holding ports 112 and to the associated set of bunch holding ports 152. The trailing edge 196 is so angularly disposed, as will be apparent from FIG. 12, that the aforesaid suction is applied to the various ports 112 and 152 of any particular set of suction ports, just prior to the time that these suction ports reach the wrapper pick-up station 74. Therefore, as the periphery of the drum approaches the wrapper pick-up station, the wrapper-holding suction ports 112 will have suction thereat and are prepared to pick up and hold a wrapper transferred to the drum from the belt 104. At the same time the bunch grooves 150 will have suction applied thereto so that they are ready to hold bunches supplied to them at the bunch input transport means 62. The application of suction to the ports 152 over the arc of the drum from the wrapper pickup station to the bunch input transport means does not cause any substantial loss of suction so that it is not necessary further to modify the machine 50 in such a fashion that the application of suction to the ports 152 is delayed until they approach said means 62.

The foregoing description outlines the initiation of the application of suction to the various ports 112 and 152. Such suction must be cut off eventually and it is highly desirable to do so with a timing such that the bunches are released as they start to move relative to the circumference of the wrapping drum in a manner soon to be described, on other words, as they shift out of the grooves 150, and such that each wrapper is released progressively slightly before the moment that the segment of the wrapper released is spirally wrapped about a bunch.

Suction is cut off from any individual outlet suction port at the time that the corresponding inlet suction port 188 crosses the leading edge 198. The port 188 of any given series connected to the outlet port 112 at the leading apex 96 of a wrapper, e.g. corresponding to the dot 134, is the foremost port 112 on the drum, so that this port is the first to cross the edge 198. This crossing takes place just before the moment that the dot 134 engages the bunch about which the wrapper associated with that dot is to be spiraled around such bunch. The next inlet port 188 of the same series will cross the edge 198 just before the part of the wrapper corresponding to the port 112 starts to be applied to a bunch. Hence, the progressive releasing action mentioned above is effected. One of the suction inlet ports 188 which is connected to the outlet suction ports 152 for a bunch to which a wrapper associated with its series is being applied likewise will cross the edge 198. This crossing takes place early in the cut off and it has been found that good results are obtained where said inlet port 188 for the ports 152 associated with the groove 150 for the bunch being wrapped, is the third port in the series.

Due to the fact that the machine 50 does not operate in a "clean" room free of air-borne particulate matter and, indeed, since the machine is handling a natural product, tobacco, which sheds particles and, furthermore, since the outlet suction ports 112, 152 are, at various parts of their travel, exposed to a particle laden atmosphere while suction is present thereat, the bores associated with these ports cannot be prevented from inspirating foreign material. It therefore is desirable to periodically clean the bores. This is accomplished by air pressure means such as a pressure line 200 (FIG. 8) secured to the annular ring 190 and extending through a bore 201 therein to a short radial pressure port 202 (FIG. 12) the length of which is such that it spans the radial width of all the series of suction inlet ports 188. When the inlet ports 188 cross the pressure port 202, air under pressure is applied to the sundry bores to blow foreign matter out of them through the various outlet ports 112 and 152. The pressure port 202 is located at a point beyond the bunch output transport means 64 where the drum is free of wrappers and bunches; this is between the bunch output transport means 64 and the wrapper pick-up station 74.

At the wrapping station 154, several things occur. For clarity of description, these will be described briefly before detailing the specific operations and mechanisms used to accomplish the same.

At such station the bunches and the wrappers are so relatively moved that a bunch rolls along angularly with respect to the longitudinal axis of the associated wrapper, starting at the leading portion 96 of the wrapper on the drum 76 and continuing until the bunch reaches the flag 98 at the trailing portion of the wrapper. While the bunch and flag are experiencing such relative movement, both the bunch and the flag are experiencing joint movement, although at different speeds, through the wrapping station. In this case, this joint movement is in the direction of rotation of the drum, clockwise as viewed in FIG. 1. Moreover, while this joint movement is taking place, the bunch is being rotated about its own longitudinal axis. The bunch is held against the wrapper and, as the bunch rotates, it progressively picks up the wrapper in a spiral mode, causing the wrapper to be spirally wound about the bunch, the winding starting adjacent the fire end of the bunch and continuing to the rounded tapered mouth end of the bunch.

The flag is provided in order to be able properly to wrap the rounded tapered mouth end of the bunch. Up to the point that the fire end of the bunch is reached, the spiraling of the wrapper about the bunch is the spiraling of a strip about a substantially cylindrical object of substantially uniform diameter so that the wrapper can be of uniform width and uniform angular inclination with respect to the longitudinal axis of the bunch. However, this condition does not prevail at the rounded tapering mouth end of the bunch, hence the provision of the flag which is of tapering width and curlicue terminal configuration which enables it to be wrapped relatively smoothly about said rounded tapering mouth end and to overlie the tip of the mouth end.

At the wrapping station, the wrapper which was uniformly applied over the cylindrical portion of the bunch has its angular orientation progressively varied as the flag is applied to the rounded tapering mouth end in order that the flag continuously may be applied approximately tangentially to the mouth end as the curvature and diameter thereof varies. Moreover the flag is fed to the mouth end more slowly and with a decreasing pitch of the spiral in order to lay the flag as smoothly as possible on the rounded tapered mouth end. Furthermore, near the very end of the wrapping of the flag about the mouth end, the flag is caused to pop away from the drum in order to be correctly disposed with respect to the mouth end at the last moment and thus be able to lie across the tip of the mouth end. To achieve the foregoing special effect in the handling of the flag, the flag of each wrapper is supported by an individual flag carrier which experiences three types of motion relative to the drum during the application of the flag to a bunch; these are: aft motion which reduces the speed at which the flag is fed to the bunch, inboard motion which reduces the pitch of the spiral and rotary motion which changes the angle at which the flag is presented to the bunch.

At the very end of the wrapping of the flag on the mouth end of the bunch, it is preferable to apply a molding, i.e. shaping, action to provide a smooth surface configuration for the mouth end, and an even smoother configuration is obtained by virtue of a rolling and pressing operation.

The rolling of the bunches and the spiral application of the wrappers to the rolling bunches is performed continuously on any given bunch and its associated wrapper and, to maximize output of the machine, such rolling and wrapping action is practiced upon successive bunches and wrappers in an overlapping manner; or, phrased differently, after one bunch has been rolled and partially wrapped, the rolling and wrapping of a succeeding bunch is started and, if desired, while the first two bunches are rolling and being wrapped but are at progressively different stages of the wrapping operation, another bunch or other bunches have started and may have progressed partway through their rolling and wrapping operations, so that at any given time more than one bunch is being rolled and having wrappers spirally applied thereto. It will be recalled that the wrappers are spaced apart from one another circumferentially of the wrapping drum by gaps which represent missing wrappers, since the machine picks up every other wrapper from the vacuum belt 104. Thus, the overlapping rolling and wrapping operation are essentially inherent in the machine as it is constituted, and this is desirable for mass production.

Turning now to the individual mechanisms for performing the sundry operations above described, attention is directed to FIGS. 1, 4, 5, 6 and 12 in which the rolling action of the bunches at the wrapping station 154 best is illustrated. Initially, a bunch is carried to the beginning of the wrapper station by rotation of the drum 76, the bunch being held at this time in a groove 150 by suction applied at the suction outlet ports 152. FIG. 6 shows a bunch at the time of its release from the feed drum 144 and its acquisition by the carrier drum 76. For a short time this bunch is between the input delivery means 62 and the wrapping station, being held in the groove 150 by the outlet suction ports 152. The carrier drum very quickly moves this bunch to the wrapping station. The wrapping station includes a wrapping shoe 204 which is a stationary arcuate segment mounted on the plate 52. The shoe 204 has an inner surface facing the circumference of the drum which inner surface is coaxial with the drum and is spaced from the drum to provide an annular wrapping gap 206 the width of which is slightly less than the diameter of a bunch, being sufficiently less to lightly compress, i.e. squeeze a bunch between it and the drum. In the position of the bunch illustrated in FIG. 4, the tip of the tooth 148 has not yet quite swung past the bunch being delivered to the wrapping station. As the tip reaches its point of last engagement with the bunch, it nudges the bunch out of the groove 150 and onto the ungrooved circumference of the drum. This will cause the bunch to engage the shoe 204 and, as just mentioned, be lightly squeezed between the shoe and the drum. At this occurs, the bunch is held mildly compressed between two relatively moving surfaces, one of which is the inner surface of the stationary shoe 204 and the other the moving surface of the drum 76. The instant that this happens, the bunch starts to roll, being driven abouts its longitudinal axis by the passage of the circumference of the drum under it, even as the bunch is engaged and being rolled on the inner surface of the shoe 204.

Figure 5:
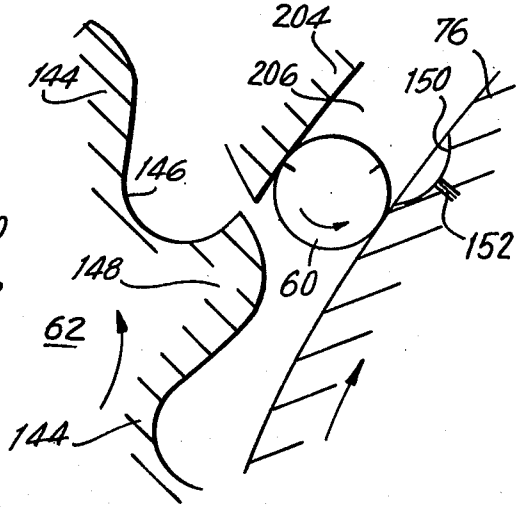

The rotary motion of the bunch about its longitudinal axis is counter-clockwise as seen in FIG. 5. Of course, while the bunch is turning about its own axis, it also is being transported in the direction of rotation of the drum, i.e. clockwise, as seen in FIG. 5. This clockwise motion is a bodily motion of the bunch, i.e. a shifting of the longitudinal axis of the bunch in such direction and is to be distinguished from the rotation of the bunch about its own longitudinal axis. Inasmuch as one of the surfaces on which the bunch is rolling is stationary and the other surface is moving, the bunch is transported at mean speed midway between the stationary and rotary speeds of the shoe 204 and drum 76 and, therefore, with respect to the drum, appears to be lagging at half speed. This can be appreciated by inspection of the relative positions of the bunch and the groove 150 between FIGS. 4 and 5 and between FIGS. 5 and 6. It will be seen from this comparison that the bunch is moving clockwise in an absolute sense but is moving counter-clockwise with respect to the drum which is turning clockwise. The rolling of the bunch continues as it moves through the wrapping station. The rolling action imparted to the bunch with the arrangement just described will results in the linear rotary speed of the circumference of the body of the bunch matching the linear speed of the circumference of the drum so that there will be no aft movement of the wrapper with respect to the body of the bunch, although, as shortly will be seen, such a motion is imparted to the flag end of the wrapper at the mouth end of the bunch. In an embodiment of the invention subsequently to be described, a structure will be detailed by the use of which such movement of the wrapper can be applied to the body of the bunch.

At the time that the bunch starts to roll between the shoe and the drum, it has, by virtue of its place of deposit from the transfer drum 144, contacted the leading end 96 of its now-associated wrapper and adhered to the same because of the glue dot 134, so that as the bunch now rolls on the drum retrogradely, it rolls over and picks up the associated wrapper and the wrapper thereby is spirally applied to the bunch. As the wrapper progresses sprially around the bunch, the suction which holds it to the drum is cut off progressively. Such application of the wrapper to the cylindrical portion of the bunch is carried out in a uniform manner until the tapered mouth end of the bunch is reached, at which time the aforementioned special handling of the wrapper at the flag end is performed.

To achieve a nice appearance to this end of the bunch, it is desirable to override the uniform application of the wrapper which is imparted solely by virtue of the rolling of the bunch on the drum 76. The override, which applies just to the flag end, is such that the wrapper at this time is moved opposite to the motion of the drum and also is moved inboard, i.e. toward the plate 52, and at the same time is turned about an axis perpendicular to the surface of the drum so as to twist the flag end of the wrapper in a plane tangential to the drum surface. This composite overriding motion causes the flag to be presented to the tapered end of the bunch in such manner as to be smoothly applied to the curved taper surface of the mouth end of the bunch, thus achieving a wrapped cigar which is well shaped at the mouth end.

In order to create such composite motion, there is provided in association with each series of outlet suction ports 112 that is associated with a particular wrapper, a flag carrier 208 (FIG. 13 – 23, 29 and 30). The flag carrier has an outer surface 210 which is in the plane of the cylindrical surface of the drum 76, the drum having such a large diameter with respect to the flag carrier that at the portion of the drum where the flag carrier is located the outer surface of the drum may be considered to be flat. The drum has an outwardly facing pocket 212 for each flag carrier. It will be appreciated that there are a large number of flag carriers, a different one for each wrapper position. Each pocket is deep enough to fully receive the flag carrier and its supporting and operating structure so that the outer surface 210 of the flag carrier is essentially flush with the carrier drum surface and basically is a continuation of the carrier drum surface in which the suction outlet ports 112 are disposed. This relative juxtaposition of the parts is most clearly seen in FIGS. 13 and 14.

Figure 14:
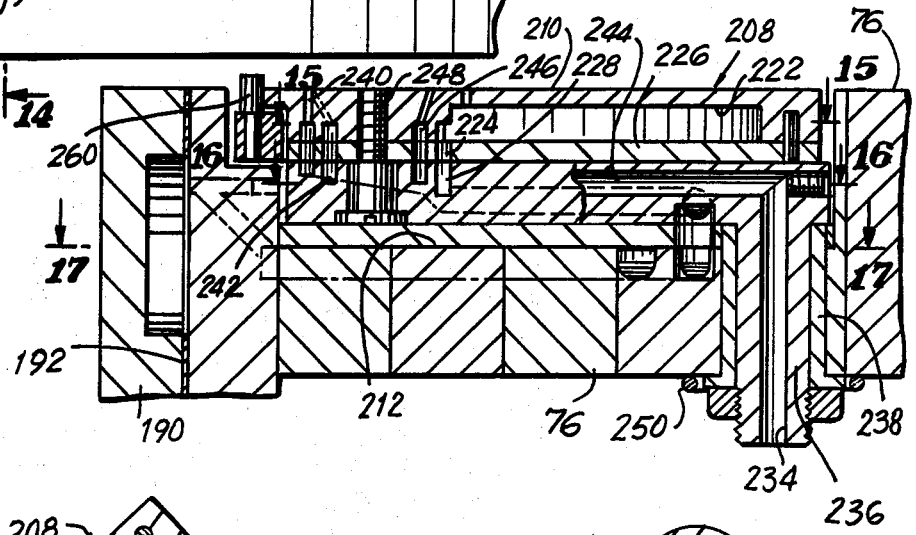
FIG. 14 is a cross-sectional view taken substantially along the line 14—14 of FIG. 13 through the carrier, with the vacuum and pressure ports being shown for initially holding the flag of the wrapper while the mouth end of the cigar is being formed and at the last moment blowing the tip of the flag away from the carrier drum.
Figure 15:
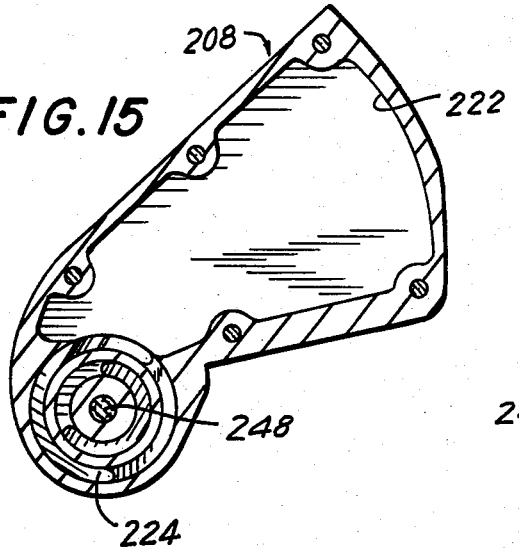
FIg. 15 is a sectional view taken substantially along the line 15—15 of FIG. 14 and illustrating the hollow interior of the flag carrier as well as the pressure and vacuum connections concentric about the axis of rotation of the translating link for the flag carrier.
Figure 16:
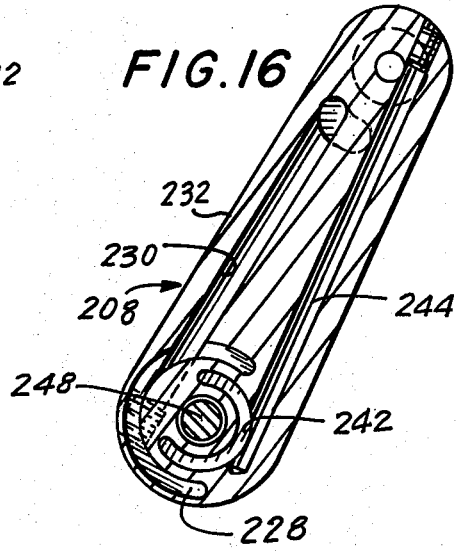
FIG. 16 is a sectional view taken substantially along the line 16—16 of FIG. 14 and showing internal details of the translating link.
Figure 17:
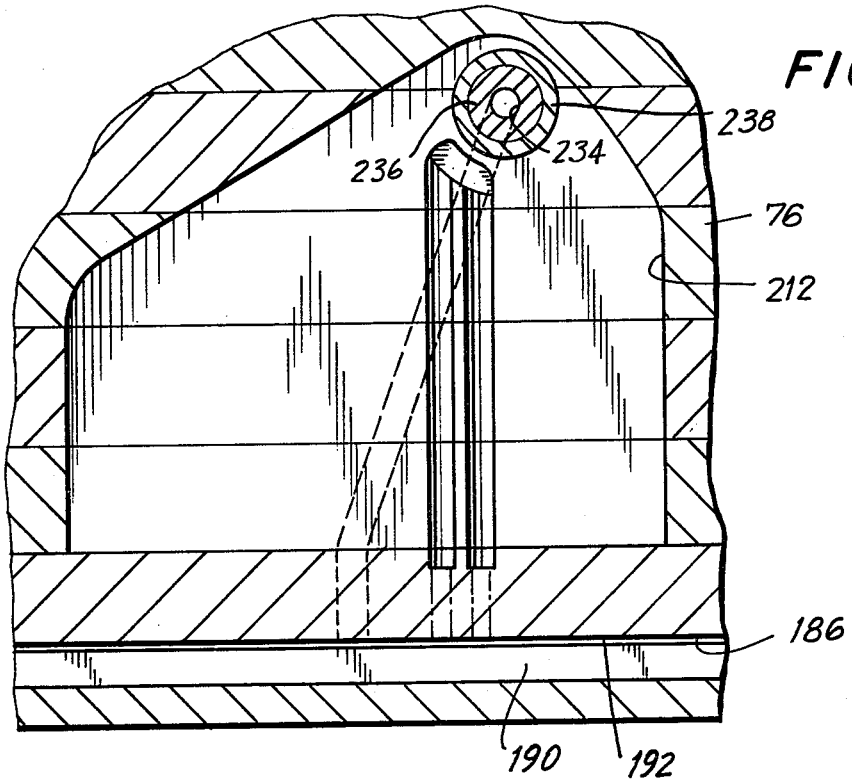
FIG. 17 is a sectional view taken substantially along the line 17—17 of FIG. 14 and showing the cut out in the carrier drum into which the translating link and flag carrier is set.
Figure 18:
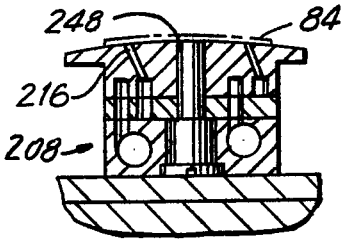
FIG. 18 is a sectional view taken substantially along the line 18—18 of FIG. 13.
Figure 19:
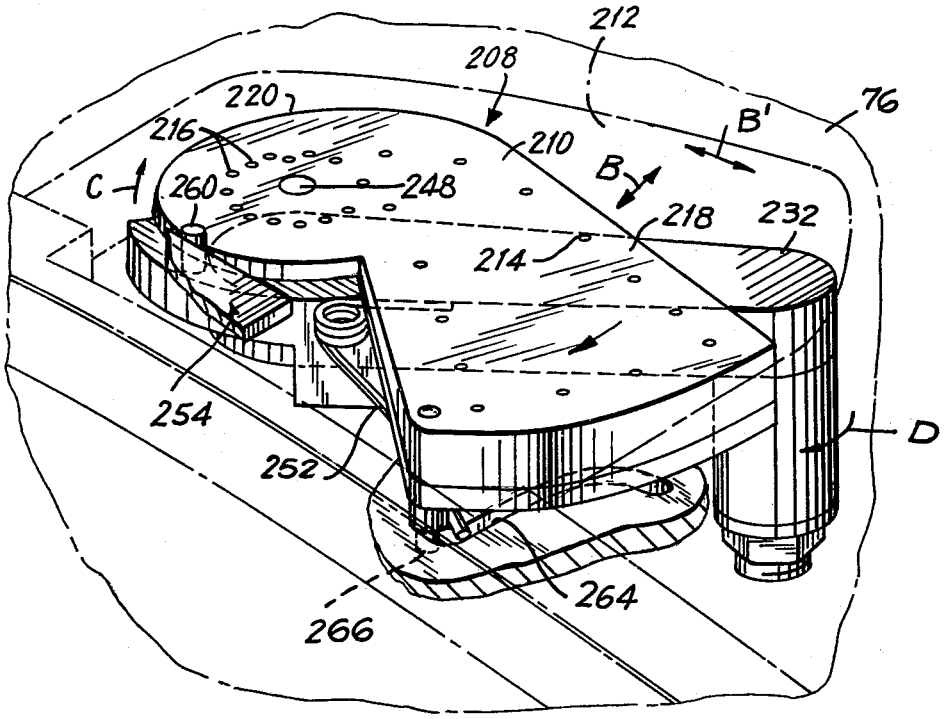
FIG. 19 is a perspective view of the flag carrier as it approaches its terminal wrapping position, with the cam follower pin riding in a slot cam in the drum to turn the wrapper flag to its final position for correct presentation to the end of the rounded tapered tip of a bunch.

The flag carrier has two groups of outlet ports 214, 216, the ports 214 being located in a tapering part 218 of the flag carrier, and the ports 216 being located in a circular terminal end 220 of the flag carrier. The respective locations of these ports, tapering part and terminal end best are illustrated in FIG. 19. The tapering part 218 is hollow, the internal cavity being denoted by the reference numeral 222 (FIGS. 14 and 15). This cavity is at a sub-atmospheric pressure when a wrapper is picked up at the station 74, the covity being connected to one of the inlet suction ports 188 through a series of passageways which include: a passageway 224 in the bottom 226 of the flag carrier, passageways 228, 230 in a translating link 232 on which the flag carrier is mounted, a passageway 234 in an axle 236 that is part of the translating link and that is rotatably mounted in a journal 238 radially disposed in the carrier drum 76, and a bore (not shown) leading from the passageway 234 to one or a few of the suction inlet ports 188 near a trailing end of a series of such ports associated with the wrapper at the station of which the flag 208 forms a part. Thus, the ports 214, in effect, constitute a continuation of the ports 112 and, while the wrapper is being applied to its associated bunch, will hold the associated part of the flag against the carrier drum.

It also is preferable to have sub-atmospheric pressure present in the ports 216 in the terminal end 220 of the flag carrier while the wrapper is being applied and before the wrapping operation reaches the flag end whereby to hold the terminal trailing end of the wrapper againt the drum during all but the last part of the wrapping cycle. To do this, the ports 216 are connected to the passageway 224 by bores 240. The passageway 224 to which the bores 240 are connected in a semi-circular passageway which, as later will be appreciated, is connected to the passageways 228 and 230 and, hence, to suction, during all of the wrapping operation except for the very end part thereof. The passageway 228 likewise is semi-circular, having a center coincident with the center of the passageway 224. As soon will be seen, the flag carrier experiences relative rotational movement with respect to the translating link, the passageways 224 and 228 being so related that, except at the very end of a wrapping operation, these passageways are interconnected to provide suction to the bores 240. However, at the very end of the wrapping operation, the connection between the passageways 224 and 228 is cut off whereby suction is removed. The translating link has another passageway 242, this being connected to a passageway 244 that is connected by a bore (not shown) to the pressure line 200. The passageway 242 is an arcuate passageway, having the same center of curvature as that of passageways 224 and 228. The passageway 242 at the very end of the wrapping operation is aligned with a passageway 246 in the flag carrier that is connected to the bores 240 above-described. Thereby at the very end of the wrapping operation when suction is cut off to the ports 216, pressure is applied to them so as to blow the curlicue of the flag end of the wrapper away from the flag carrier.

The translating link 232 is rotatably secured to the flag carrier 208, and specifically to the terminal end 220 of the flag carrier, by a bolt 248, thus enabling the flag carrier to experience a rotary or twisting movement with respect to the carrier drum as aforesaid, the twisting movement being about an axis perpendicular to the outer surface of the carrier drum inasmuch as the bolt 248 is oriented in a radial direction with respect to the axis of rotation of the carrier drum.

The translating link is mounted for rotation with respect to the carrier drum about an axis perpendicular to the surface of the drum this being the purpose of the axle 236 and the journal 238. It will be appreciated that, by virtue by the foregoing mounting arrangement, the flag carrier, as a whole, can experience movement about the axis of the journal 238 which includes a fore and aft component B and an inboard and outboard component B′ (see FIG. 19). The fore component is opposite to the direction of movement of the drum whereby when the wrapper has been released from the drum but not from the flag and still is held by the tapering part 218 and the terminal end 210 of the flag carrier, the wrapper will be moved relative to the drum 76 in the direction of bodily movement of the bunch whereby to compensate for the reduced diameter of the bunch during the period that the mouth end of the bunch is being wrapped. The inboard component reduces the pitch of the spiral to compensate for the tapering of the flag end and to aid the flag end in conforming to the rounded tapering shape of the mouth end of the bunch. Furthermore, by virtue of the relative rotation between the flag carrier and its translating link, as distinguished from the relative movement between the translating link and the carrier drum, the flag carrier will turn about the longitudinal axis of the bolt 248 in the direction indicated by the arrow C (FIG. 19), this providing a rotational motion or angular twisting of the flag carrier. This angular motion principally occurs, as shortly will be apparent, at the very end of the wrapping action when only the curlicue of the flag is held by the flag carrier and after the wrapper has been released from the surface of the drum and also been released from the tapering part 218 of the flag carrier.

Means is included to mount the flag carrier in a fashion such as to permit these various translatory and rotary motions to be effected, such means cooperating with the journal 238 and the bolt 248. Said means include a torsion spring 250 associated with the axle 236 and arranged to bias the axle in a rotary direction indicated by the arrow D in FIG. 19, the effect of which is to bias the flag carrier in a direction opposite to the resultant of the direction indicated by the arrows B and B′. A hairpin spring 252 biases the flag carrier to rotate in a direction opposite to the direction indicated by the arrow C. The springs 250 and 252 jointly act to bias the flag carrier to its idle position indicated in FIG. 13 which effectively is its rest position with regard to the carrier drum and the position which it occupies at the time of application of a wrapper to the carrier drum at the station 74. In such idle, i.e. rest, position, the tapering part 218 and terminal end 220 of the flag carrier are positioned to pick up the flag, including the curlicue, of a wrapper picked up by the drum 76.

In order to achieve the desired translatory and rotational movement of the flag carrier with the assistance of the mountings just described, two cams and followers are employed. One cam and follower effect rotation of the translating link relative to the carrier drum and, hence, bodily translatory movement of the flag carrier, and the other cam and follower effect rotational movement of the flag carrier with respect to the translating link.

Figure 13:
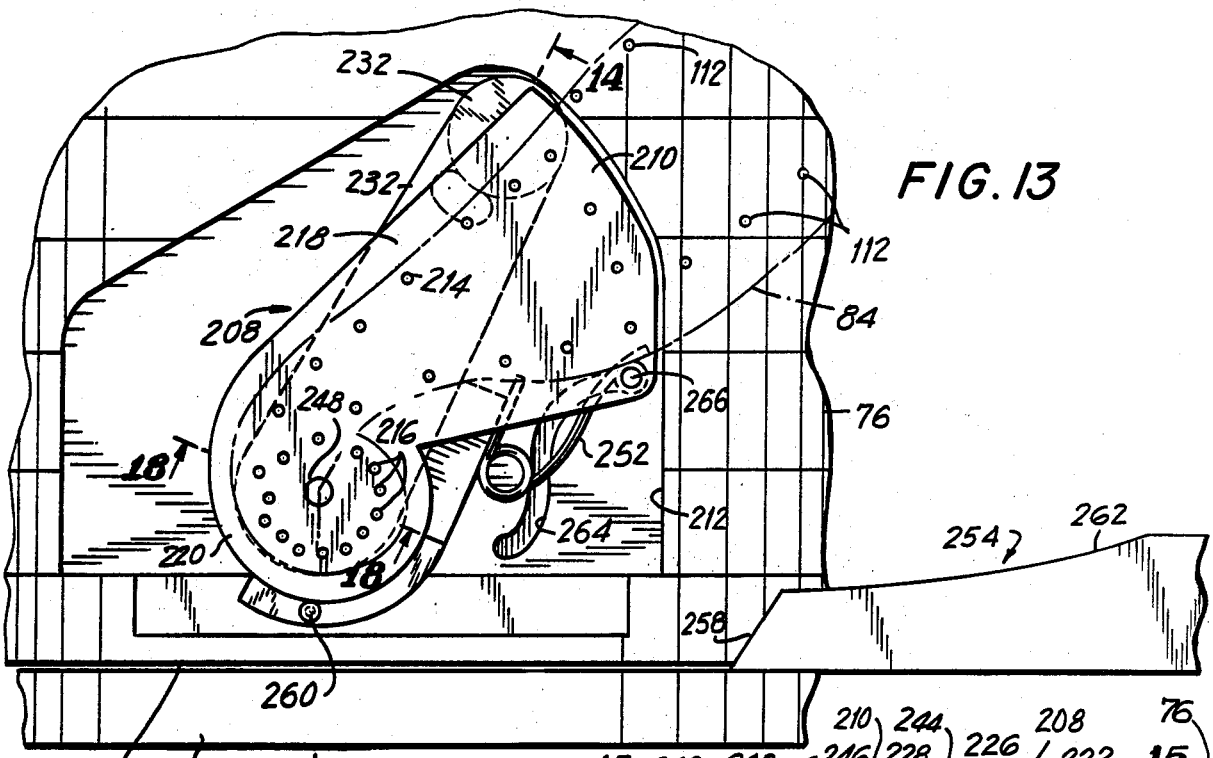
FIG. 13 is a plan view of the flag carrier in idle position in a pocket in the drum, with an associated wrapper shown in phantom.

The first cam, i.e., the one causing rotational movement of the translating link, is denoted by reference numeral 254. It is an edge cam which is mounted on a stationary cam plate 256. At the beginning of a wrapping action, edge 258 of the cam 254 is spaced from a follower pin 260 fixed on the end of the translating link remote from axle 236 (FIG. 13). As the wrapping action progresses and as the portion of the wrapper being spirally applied to the bunch nears the mouth end of the bunch, the edge 258 engages the pin 20. This edge is angled with respect to the longitudinal axis of the drum, and thus upon first contact with the pin it will start to swing the pin about the axis of the journal 238. The initial motion is small because the pin 260 quickly leaves the edge 258 and starts to ride along the edge 262 of the cam 254, which edge has a much less acute angular relationship to the longitudinal axis of the carrier drum. The edge 262 slopes gradually toward the mounting plate 52 so that as the pin 260 progressively is engaged by the edge 262, the translating link gradually will swing in a direction opposite to that indicated by the arrow D, the effect of this being to move the flag carrier bodily in the direction indicated by the arrow B. After the wrapping action is completed, the edge 262 drops off the pin 260 to permit the translating link to be restored to its idle position by the spring 250.

The twisting action, i.e. angular rotation of the flag carrier in the direction indicated by the arrow C, is effected by a slot cam 264 formed in the base of the pocket 212, and hence in the carrier drum 76. A follower pin 266 (FIGS. 13 and 19) fixed to the underside of the flag carrier rides in the slot cam. As the translating link is turned about the journal 238, due to co-action between the cam 254 and the follower pin 260 the follower pin 266 slides along the slot cam 264. The slot cam is of S-shape, extending generally in a direction away from the mounting plate 52. Thus, as the follower pin is pulled along the slot cam, it will cause the tapering part 218 of the flag carrier to shift toward the cam plate 256. This will turn the flag carrier about the bolt 248 and bring about the desired rotation in the direction of the arrow C. When the follower pin 260 rides off the edge cam 254 and the translating link returns to its rest position, the follower pin 266 likewise will ride back in the slot cam 264 to restore the flag carrier to its idle position to await the application of another wrapper to the carrier drum and flag carrier.

To appreciate the manipulation of the flag end of the wrapper as it is applied to a bunch, reference is directed to FIGS. 20 – 24. FIG. 20 illustrates the termination of the spiral application of a wrapper 84 to a bunch 60 at approximately the end of the wrapping of the cylindrical portion of the bunch and just as the wrapping of the flag about the tapered mouth end of the bunch is started. At this time the bunch is turning in the direction indicated by the arrow E (FIG. 20) and the flag carrier is moving with the drum in the direction indicated by the arrow F. The flag carrier is about to begin its angular rotation about the bolt 248 in the direction indicated by the arrow C.

Figure 21:
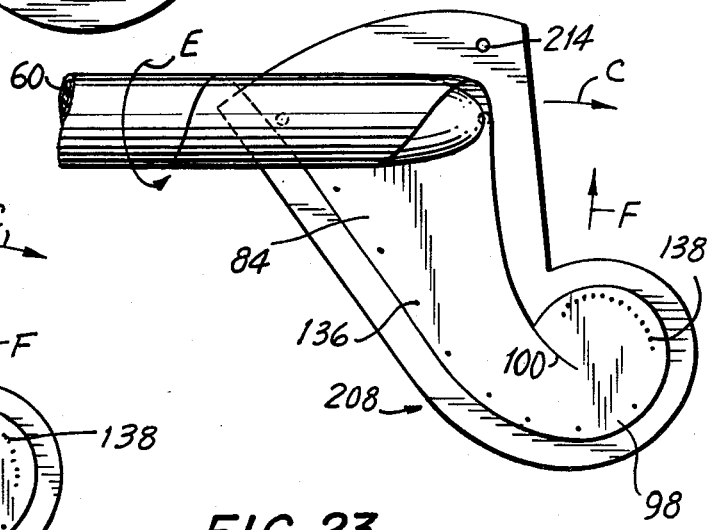
FIG. 21 is a view similar to FIG. 20 but illustrating the flag carrier at a slightly advanced position during the wrapping of the rounded tapered mouth end.

Turning to FIG. 21, which shows a following relative positioning of the parts, the bunch still is turning in the direction indicated by the arrow E but application of the flag to the mouth end of the bunch has started. The flag carrier now is moving in the direction indicated by the arrow F but at a lesser speed, so the relative position thereof is more retrograde with regard to the position of the bunch than it would be if the bunch simply were rolling on the surface of the drum and the flag carrier were stationary. Moreover, the flag carrier has progressed in its movement indicated by the arrow C so as to present the flag to the mouth end of the bunch in a more clockwise position whereby to tend to present the wrapper tangentially to the rounded tapering end of the bunch.

Figure 22:
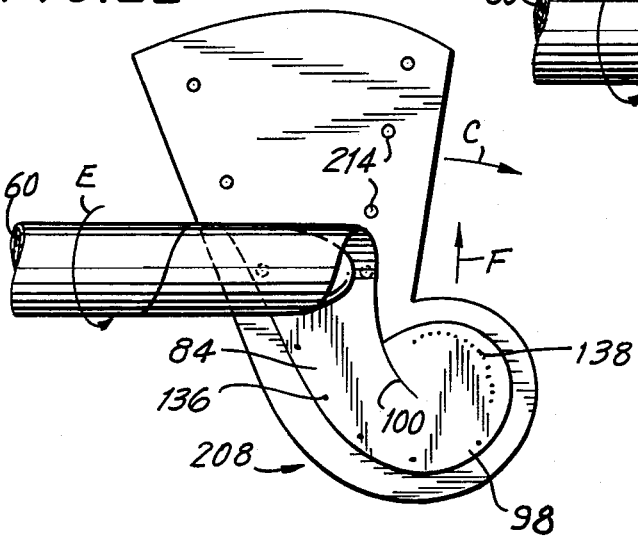
FIG. 22 shows a position subsequent to that illustrated in FIG. 21.

FIG. 22 shows a further step in progression, the flag carrier now having turned more to keep the flag tangential to the more severely curved portion of the tapered mouth end of the bunch.

Figure 23:
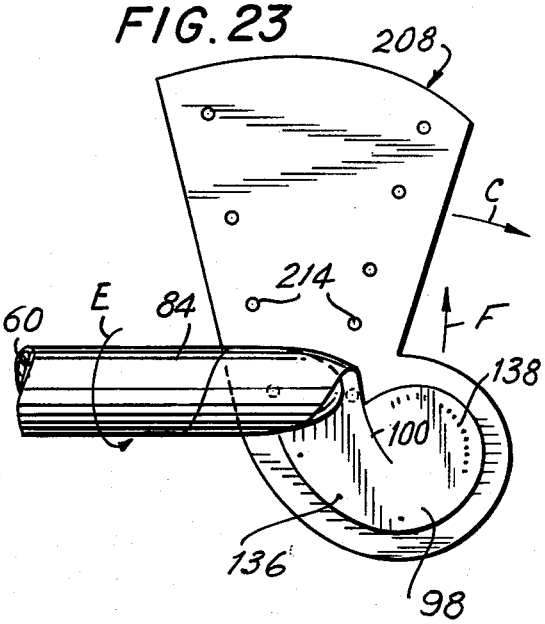
FIG. 23 is a view illustrating the positions of the parts shortly after that seen in FIG. 22.
Figure 24:
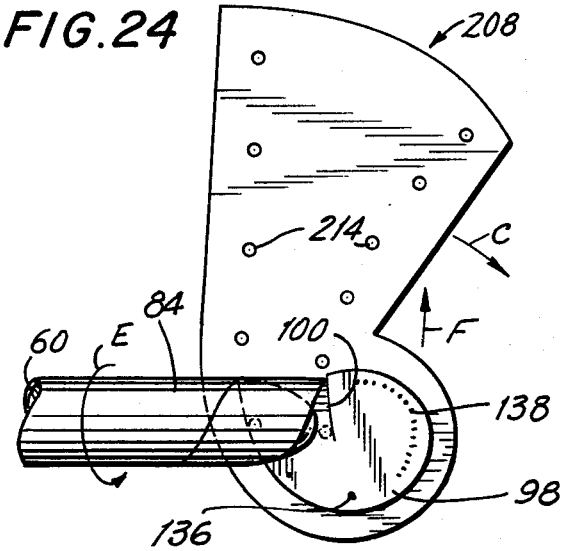
FIG. 24 is a view showing the positions of the parts shortly after that illustrated in FIG. 23.
Figure 25:
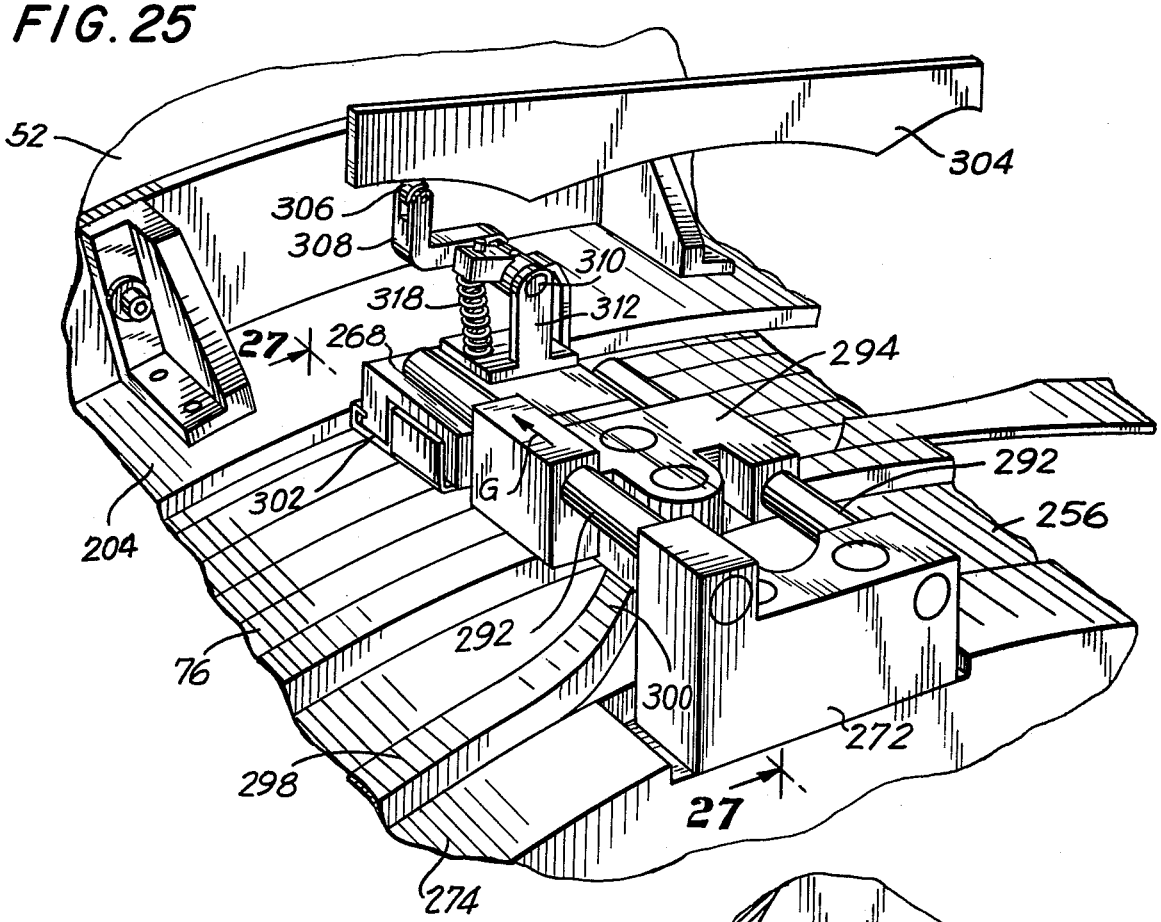
FIG. 25 is a perspective view of a header block, the carrier drum, the stationary wrapping shoe and the ridge cam, with the header block being illustrated in a position in which it is substantially at the mouth end of the bunch being wrapped so as to correctly guide the flag of the wrapper being applied to its proper position on the mouth end of said bunch.

FIGS. 23 and 24 show still further turning of the flag end of the wrapper in order better to follow the aforesaid tapered rounded shape of the mouth end of the bunch as its radius of curvature lessens.

Attention is called to the progressive exposure of the ports 214 which throughout the application of the flag end to a bunch have suction therein until the curlicue is reached.

Attention next is directed to FIGS. 29 and 30 which show the very end of the application of the wrapper, namely, the application of the curlicue. By this time the wrapper has been applied not only to the cylindrical portion of the bunch, but to most of the rounded tapered mouth end, and there is left only the last bit of wrapping for the very tip of the bunch. This occurs near the end of the rotational movement of the flag carrier about the bolt 248.

In FIG. 29 it will be seen that the curlicue has started to be applied to the rounded tapered end of the bunch and the flag carrier is experiencing the last of its rotational movement in the direction of the arrow C. Almost all of the mouth end by now has been covered, but the tip of the bunch still must have the wrapper applied across it. For this purpose the curlicue is provided with the separation 100 in the form of a slit which is radially oriented on the curlicue. As the wrapper is spirally applied to the bunch near the tip of the mouth end, the wrapper is rolled up on the mouth end of the bunch along one edge of the slit 100 while the other edge of the slit and the adjacent part of the curlicue remains against the flag carrier (FIG. 29). As the rolling progresses to near the blind end of the slit 100, suction is removed from the ports 216 and air under pressure is applied to them, the beginning effect of the pressure being shown in FIG. 30. Blowing of air out through the ports 216 forces the unwrapped part of the curlicue to pop out into the air and bends the same about the tip of the mouth end. Initiation of the bending can be seen in FIG. 30. With this part of the curlicue blown up, the curlicue crosses over the tip of the mouth end to cover the same.

Figure 26:
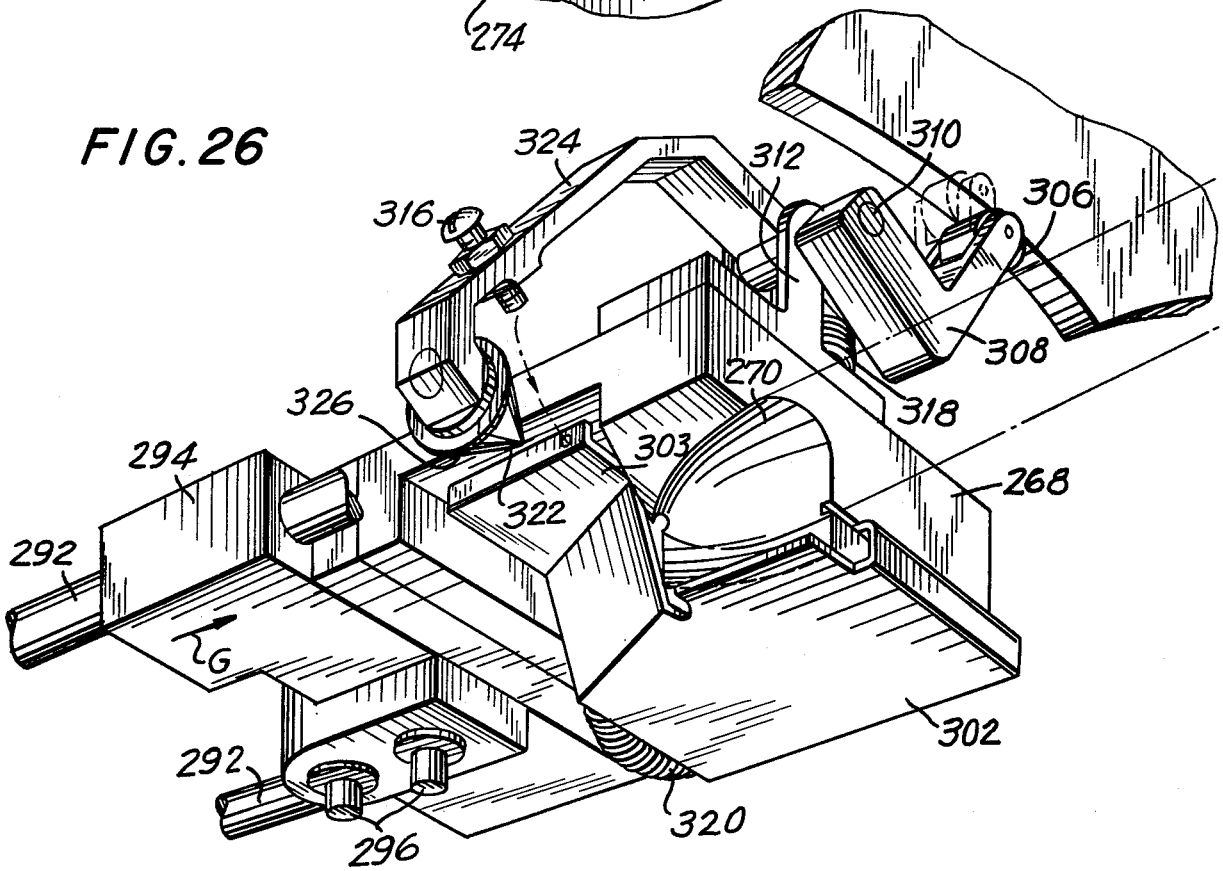
FIG. 26 is a bottom view of the header block shown in FIG. 24, the spinning cone being illustrated in full lines in a position remote from the bunch being wrapped and in phantom lines in a position adjacent such bunch.
Figure 27:
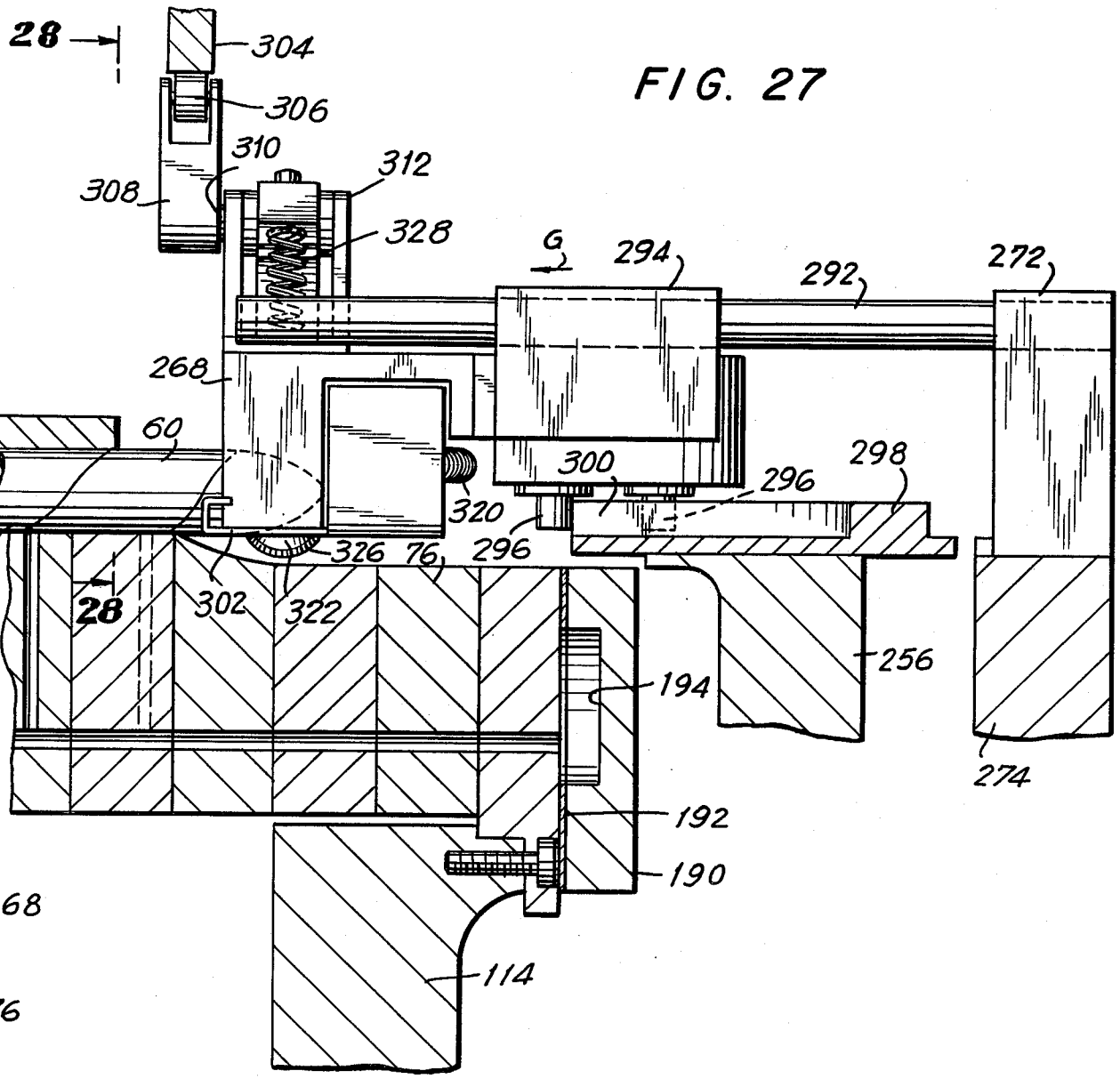
FIG. 27 is a fragmentary enlarged cross-sectional view taken substantially along the line 27—27 of FIG. 25 through the header block, the carrier drum and the flag carrier.
Figure 28:
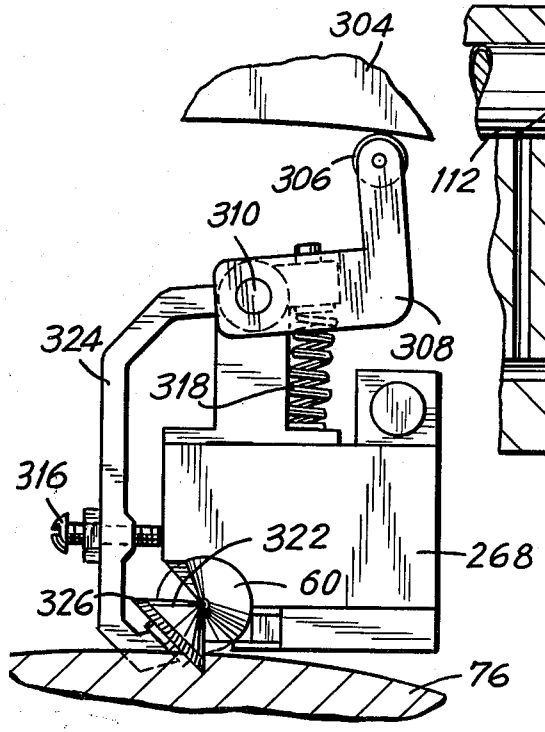
FIG. 28 is a view taken substantially along the line 28—28 of FIG. 27 and illustrating the cam that rises and lowers the cone roller for the final placing of the flag on the mouth end of the wrapped bunch.

The balance of the wrapping operation requires a description of the structure and functioning of a shaping header block against which the rotating (spinning) now-wrapped bunch turns. The header block is indicated by the reference numeral 268 and best is seen in FIG. 26. During the wrapping operation the header block is out of the way of the rotating bunch which is traveling relative to the surface of the rotating drum. The header block rotates bodily about the axis of the carrier drum at the same speed of rotation as the rotary speed of bodily translation of a rotating bunch. Each header block is physically located to track, i.e. move in alignment with, its associated rotating bunch, although axially spaced therefrom during the approach to the station for wrapping of the bunch. After the spiral wrapping operation begins, the header block is cammed into contact with the mouth end of the bunch and remains in this position until the mouth end of the cigar is complete. The popped out part of the curlicue is confined by the header block and stretcher plate so that the popped out portion is not free to flap about and be broken off the wrapper. Moreover, the moment the terminal part of the curlicue pops out, it is, without any noticeable lapse of time, pressed against the mouth end of the bunch, the header block at the same time pressing against substantially the entire length of the mouth end from the cylindrical portion of the bunch to the tip of the mouth end and even against the tip itself. Accordingly, the operational surface 270 of the header block matches the desired configuration for the mouth end of a finished cigar.

In order to effectuate the desired movement of the header block, firstly to track the bunch being wrapped, and secondly to approach the mouth end of the bunch, certain structure is provided which best is shown in FIGS. 25 – 28. There are several wrapping stations on the drum, one for each of the grooves 150 and for each of the positions occupied by a wrapper 84. Each station includes a block 272 secured to a circular mounting plate 274 (see also FIG. 7) rotatable on a bearing 276 that is fast to a hub 278 for the stationary cam plate 256. The circular mounting plate turns about the bearing 276 at a speed of rotation such as to match the speed of rotation at which the spinning bunches bodily move about the axis of rotation of the carrier drum 76.

The means employed to rotate the plate 274 includes a ring gear 280 which is fast to the drum and meshes with a large pinion 282 affixed to one end of a back shaft 284 that turns in a bearing 286 supported by the cam plate 256. The outer end of the back shaft has a small pinion 288 affixed to it, this pinion being in mesh with a ring gear 290 fast to the mounting plate 274 which carries the blocks 272. The gear ratios are so selected that the plate 274 turns in the same direction as the carrier drum but a slower speed such that the blocks thereon will track the spinning bunches.

Each block 272 supports a pair of parallel traversing shafts 292 that extend from the rotating plate 274 toward the stationary plate 52 in a direction parallel to the axis of rotation of the carrier drum. A traveler 294 is slidable on the traversing shafts, being stabilized thereby. In order to shift the traveler along the traversing shafts, the traveler supports a pair of pendant follower pins 296 (FIGS. 26 and 27) spaced apart in the direction of the length of the traversing shafts. These pins ride on opposite sides of a ridge cam 298 (FIGS. 7, 25 and 27) that extends circumferentially around and is carried by the circumference of the cam plate 256. The ridge cam has a plurality of lobes 300 that are so angularly arranged as to shift the traveler 294 toward the mounting plate as the bunch associated with the block 272 approaches the end of its wrapping cycle, the extreme movement of the traveler toward the mounting plate being at the end of the wrapping cycle. The direction of travel of the traveler toward the mounting plate is indicated by the arrow G.

The header block 268 is supported by the traveler 294. The traveler 294 also slidably supports a stretcher plate 302 that is movable with it about the drum and also is movable relative thereto in a direction circumferentially of the drum. At the start of wrapping, the header block is spaced axially away from the mouth end of a bunch being wrapped. During the spiraling segment of the wrapping cycle, the lobe 300 causes the header block to approach the mouth end of the spinning bunch in a direction G longitudinally of said bunch enabling the header block to lightly bear against the mouth of the bunch. In order to cause the stretcher plate 302 to approach the bunch in a direction perpendicularly to the longitudinal axis of a bunch, a stationary cam 304 is provided. A roller follower 306 is adapted to ride on his cam. Said roller follower is supported by a rocking arm 308 that turns about a stub shaft 310 which is parallel to the axis of rotation of the carrier drum. The stub shaft is journaled in a bracket 312 affixed to the header block 268. When the roller 306 engaged the cam 304, it depresses the rocking arm 308 forcing a leg 324, also mounted on shaft 310, to move away from the bunch. This action allows the stretcher plate 302 to slide perpendicular to the bunch under the action of a spring 320. At this time the pop-up air lifts the flag and forces it against the stretcher plate 302. The roller 306 disengages the fixed cam 304 causing the leg 324 to return by action of a spring 318. This leg contains an adjusting screw 316 which contacts an extension 303 of the stretcher plate 302 forcing it back toward the bunch.

The machine 50 includes a cone roller 322. Said roller is rotatably supported on one end of the leg 324, the other end of which is oscillatable about the stub shaft 310. The cam 304 previously noted swings the leg and the cone roller toward the mouth end of the bunch. The leg 324 holds the cone in such an angular orientation that its surface bears against the wrapped end of the cigar with the base of the cone roller substantially perpendicular to said end of the cigar so that the spinning surface of the cigar engages the cone to provide a frictional driving engagement between the cigar and cone. The conical surface of the cone adjacent its wider end is formed with a knurled band 326 to enhance frictional coupling.

It will be observed that the header block is open to enable it to approach the wrapped cigar without interference, the operational surface of the header block corresponding approximately to an arc of one-half of the surface of a wrapped cigar at the mouth end.

OPERATION

Recapitulating as to the operation of the machine 50, wrapper stock material from roll 70, an elongated strip of reconstituted tobacco or of overlapped leaves of natural tobacco, is fed between powered feed rolls 90 and then between the anvil roller 92 and the cylindrical cutting roller, i.e. slitting roller 94, where the stock material is pinched or cut to form a series of contiguous wrappers 84 of the desired shape which are picked off by the vacuum transfer roller 102. The transfer roller shifts the wrappers to the vacuum belt 104 (see left-hand side of FIG. 2). If desired, an alternate method may be employed which eliminates the cutting process and supplies pre-cut wrappers of either reconstituted tobacco or natural leaf tobacco transitorily mounted on a tape which is fed into the machine onto the vacuum belt 104.

The vacuum belt passes under the carrier drum 76 in close proximity thereto at the pick up station 74 and, as it does so, alternate wrappers are transferred in spaced relationship onto the carrier drum. The remaining wrappers (see left-hand side of FIG. 2) continue to another wrapping machine (not shown in FIG. 1). The wrappers are carried by the drum 76 to and past the pasting station 80 where they pass over a patterned paste dispenser from which paste picked up by a roller 128 and spread by a roller 130 is supplied to a patterned application roller 132. A minimal amount of paste is dabbed on the wrappers at spaced dots, and the wrappers next are brought to a star feed drum 144 where a cigar bunch 60 is placed with the fire end thereof on the leading apex 96 of the wrapper on the carrier drum. This causes adherence of the leading apex of the wrapper to the fire end of the bunch. At this moment the bunch has not yet started to spin, but has started to be transported along with and at the same speed as the carrier drum and its associated wrapper. Next, the bunch enters the wrapping station where it is lightly squeezed between the stationary shoe 204 and the exterior surface of the carrier drum, causing the bunch to commence spinning about its longitudinal axis whereby to pick up the wrapper spirally as it is applied to the bunch for the length of the wrapper, the wrapper moving with respect to the longitudinal axis of the bunch at a speed that is approximately half the angular speed of the carrier drum. The positions of the spinning bunches being wrapped determine the number, location and speed of the header blocks 268. As the initial wrapping of the bunches is begun, the header blocks 268 start to be cammed inboard (note the shape of the ridge cam 298 in FIG. 25) to enable the operational surfaces thereof to complete the wrapping and shaping of the mouth ends of the bunches. The carrier drum has inserted therein flag carriers flush with the exterior surface of the drum, there being one flag carrier for each wrapper station on the drum. The flag carrier imparts an additional motion to the flags of the wrappers as the flags are applied to the bunches. Such motion is translational in the direction that the drum turns and inboard; it also is rotational, i.e. angularly twisting, in the plane of the drum surface whereby to correctly orient the flag as it is applied to the spinning bunch. These motions are imparted to the flag carrier by cam action and are tailored to the configuration of the bunch. Vacuum and pressure ports are provided on the wrapper carrying surface of the flag carrier to hold the flag to the carrier until the last moment when it is desired to have the flag pop out.

The wrapped cigar enters an output transport means which conveys it to a flying, cleaning and smoothing means which finishes the mouth end of the cigar.

Finally, the fire end of the cigar is trimmed.

The invention can be embodied in various modified forms of which four have been illustrated in FIGS. 33 to 39.

FIRST MODIFIED FORM OF THE INVENTION

Figure 33:
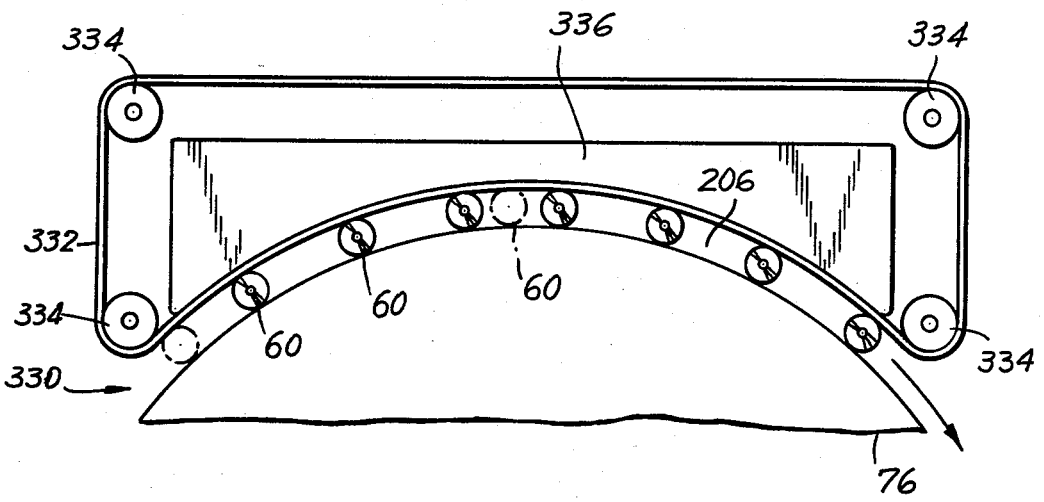
FIG. 33 is a diagrammatic view of an alternate form of the invention in which the stationary wrapping shoe is replaced by a wrapping belt so that by controlling the speed of the belt the rate of angular advance of bunches around the axis of rotation of the carrier drum can be precisely adjusted to match the angular advance of the header blocks.

In FIG. 33 a machine 330 is shown which incorporates a modification of the machine 50 for varying the speed at which the bunches 60 are spun and at which the bunches bodily move around the axis of rotation of the carrier drum 76. In this embodiment, and others where appropriate, the same numerals have been used to denote the same parts. In the machine 50 the bunches were rolled between the outer surface of the rotating carrier drum 76 and the inner surface of an arcuate stationary wrapping shoe 204. Hence, the spinning speed and traveling speed of the bunches were determined solely by the diameter of the carrier drum and its speed of rotation. In the machine 330 one additional variable factor has been provided to govern the speeds of the bunches, namely, for the stationary shoe 204, what is essentially a traveling shoe has been substituted. This traveling shoe constitutes a wrapping belt 302 that travels in a closed arcuate path concentric with the drum 76 and defined by multiple rollers 334, one of which is power driven, and a guide 336 having a concave circular surface facing the carrier drum 76. The traveling belt replaces the inwardly facing concave surface of the stationary shoe 204. The segment of the belt traversing the guide 336 at any given time cooperates with the external surface of the carrier drum 76 to define an annular wrapping gap 206 which is essentially identical with the wrapping gap 206 of the machine 50. By varying the linear speed of the belt 332, which readily is accomplished by controlling the power source that drives said belt, the relative speeds of the belt and surface of the drum can be changed at will, where, before, the shoe 204 and its interior surface were stationary. Such variation will alter the speed at which the bunches spin and the speed at which the bunches travel around the axis of rotation of the carrier drum.

SECOND MODIFIED FORM OF THE INVENTION

Figure 34:
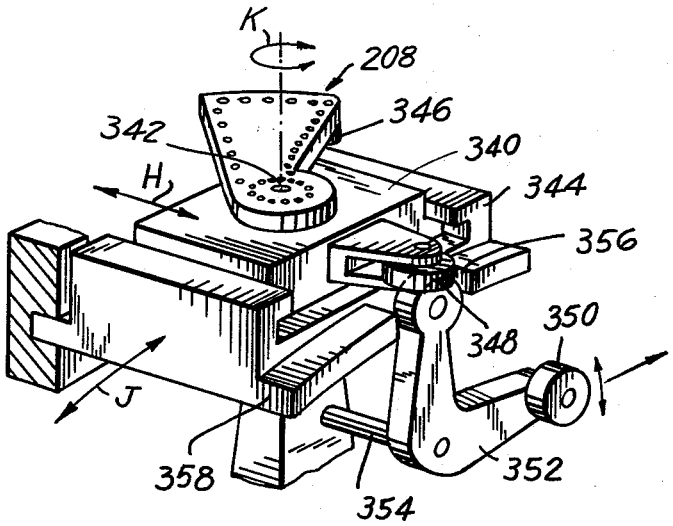
FIG. 34 is a perspective view of an alternate position changing mechanism for the flag carrier.
Figure 35:
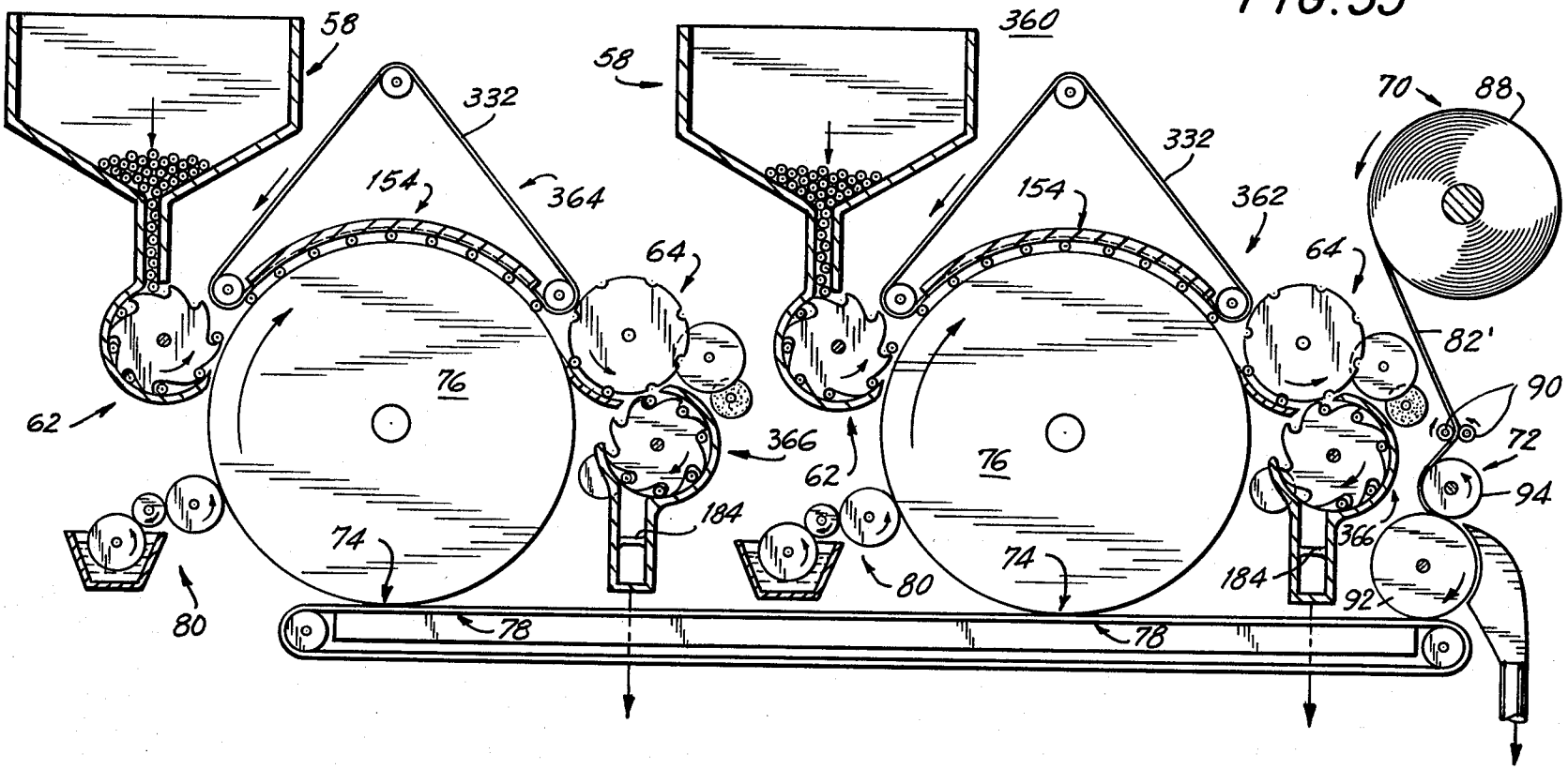
FIG. 35 is a view similar to FIG. 1 of a modified form of the invention in which two wrapping heads are employed and in which each wrapping head wraps a twinned bunch.
Figure 36:
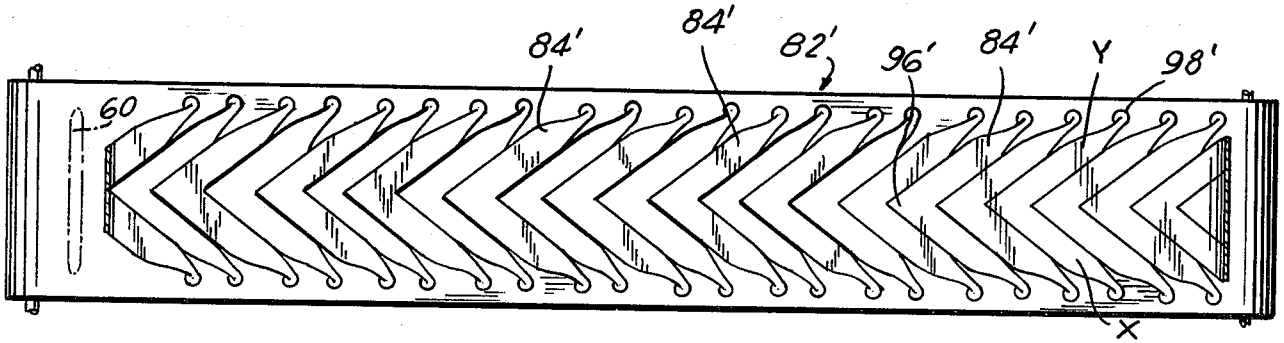
FIG. 36 is a view similar to FIG. 2 of a series of twinned wrappers arranged in chevron nested juxtaposed sequence, and wherein alternate wrappers are applied in the first wrapping drum and the remaining wrappers applied in the second head.
Figure 37:
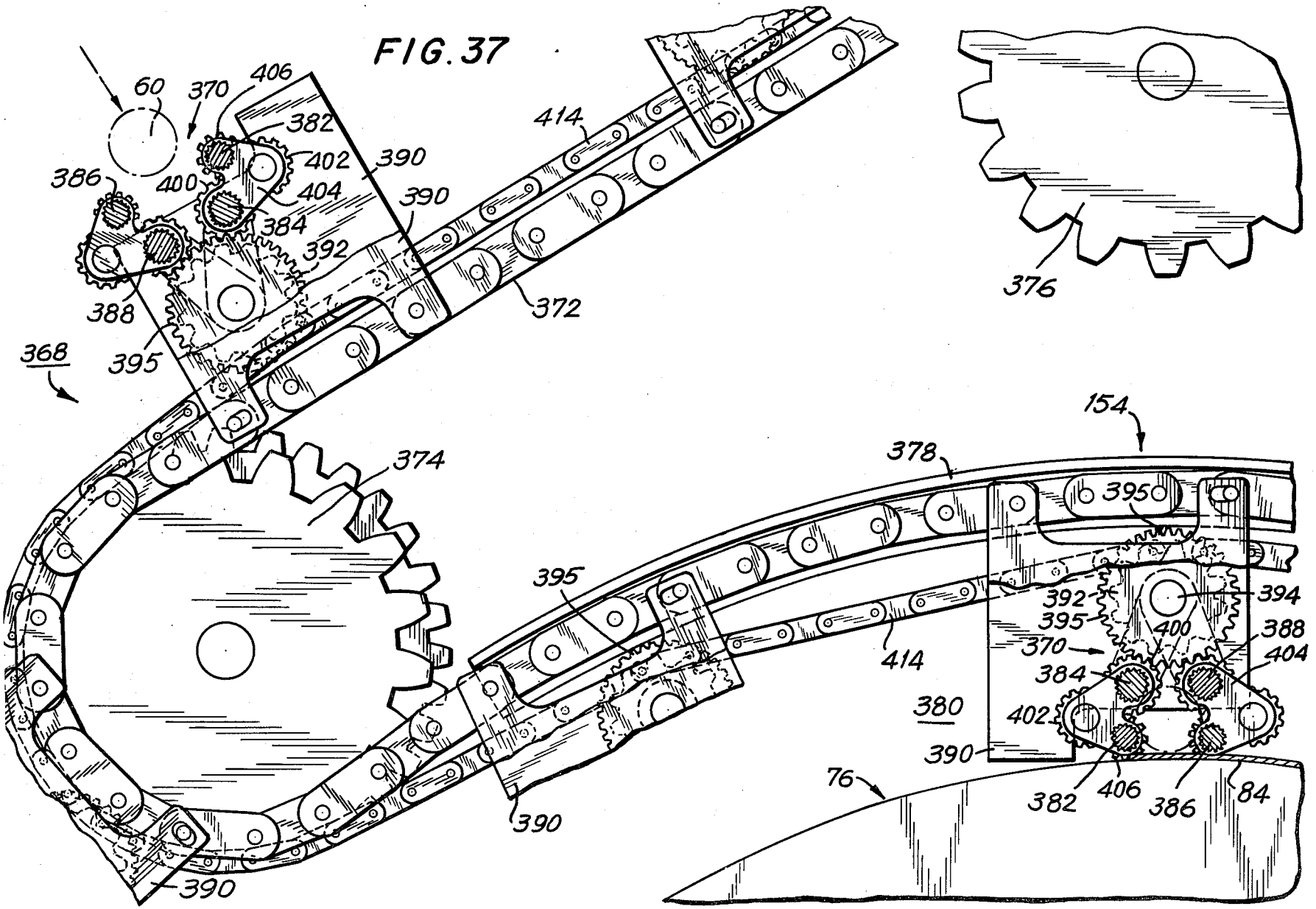
FIG. 37 is a fragmentary front view of another modified form of the invention in which the bunches, instead of being rolled between a carrier drum and a stationary wrapping shoe, are transported circumferentially of the drum during wrapping in flying rolling nests while the wrappers are transported by the carrier drum.
Figure 38:
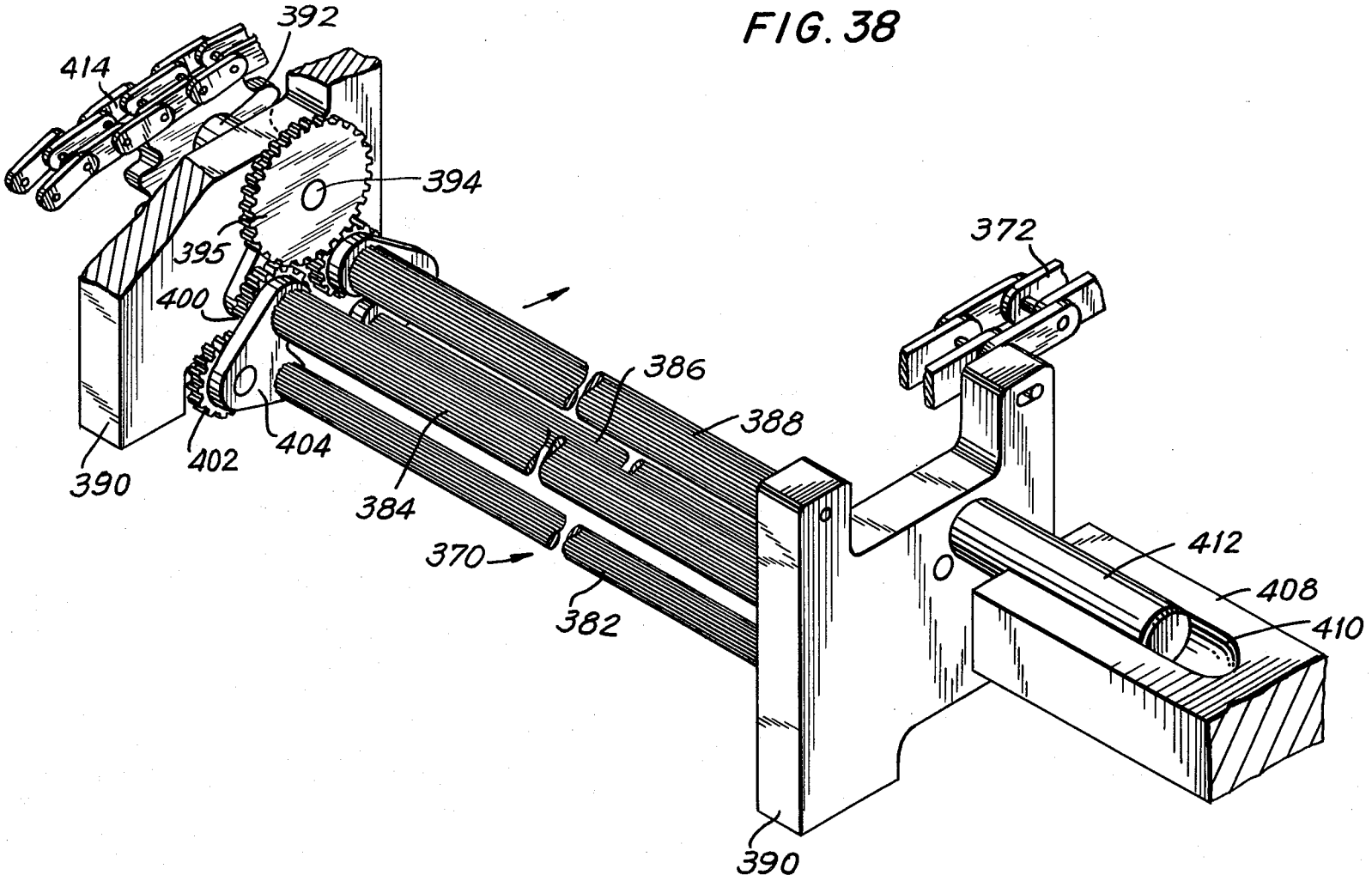
FIG. 38 is a perspective view of the rolling nest shown in FIG. 37.
Figure 39:
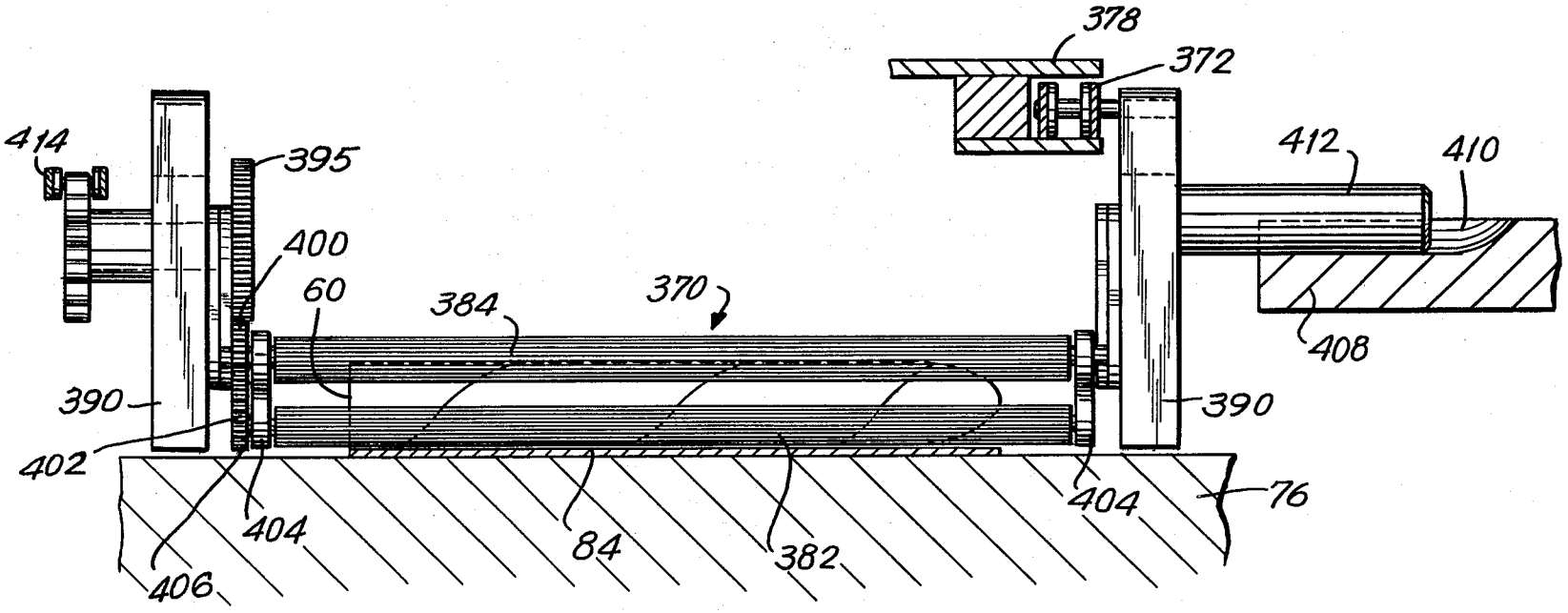
FIG. 39 is a radial cross-sectional view of said rolling nest.

In FIG. 34 a variation of the machine 50 has been shown which utilizes a different arrangement for mounting a flag carrier 208 for translatory and rotational movement as described hereinbefore and for imparting such movements thereto. In the machine 50 such movements were created by the use of an oscillating translating link and by cams operating thereon and on the flag carrier.

As mentioned previously, it is desirable to have three different motions imparted to the flag carrier. One is a translatory motion which may be referred to as "fore" and "aft", "fore" being in the direction of rotation of the carrier drum and perpendicular to the longitudinal axes of the bunches, and "aft" being opposite to "fore". Another is a translatory motion in an "inboard" and an "outboard" direction, "inboard" being toward the mounting plate 52 and parallel to the axis of rotation of the carrier drum, and "outboard" being opposite to "inboard". The third motion is a polar motion, i.e. a rotational motion, about the center of the circular portion of the flag carrier 208 on which the curlicue is supported.

As mentioned previously, the translating link 232 provides a combined fore and aft motion and an inboard and outboard motion. However, due to the oscillating path of the free end of the link where in the machine 50 the bolt 248 is located which imparts bodily movement to the flag carrier 208 as a whole, the orthogonal movements of fore and aft and inboard and outboard are trigonometrically interrelated and cannot be independently controlled, which would be preferred in order to secure the best presentation of the flag of the wrapper to the rounded tapered mouth end of a bunch.

In the structure shown in FIG, 34 the three types of motion are controllable independently of one another, unlike the fixedly interrelated control of the two orthogonal motions inherent in the translating link. More specifically, the flag carrier 208 of the FIG. 34 embodiment of the invention is identical to the flag carrier 208 of the machine 50; it has the same shape and the same suction/pressure openings. The flag carrier 208 of the FIG. 34 embodiment is connected to a transporter 340 by an erect axle 342 that is perpendicular to the direction of travel of the wrapper carrier, e.g. the drum 76. The transporter, in turn, is mounted on a support 344. A tongue and groove connection is provided between the transporter and the support such as to enable the transporter to be shiftable in a direction indicated by the arrow H which is an inboard/outboard direction. The support 344 is slidably mounted on the carrier drum (not shown) to move in a fore and aft direction indicated by the arrow J, this direction being perpendicular to the longitudinal axis of a bunch on the carrier drum. The motion in the direction J is perpendicular to the motion in the direction H. In addition, the flag carrier 208 can turn about the axis of the axle 342 in a direction indicated by the arrow K. Hence, the flag carrier is capable of three directions of motion denoted by the arrows H, J, K. Inboard motion in the direction H will reduce the pitch of the spiral of the wrapper about a bunch, such motion taking place as the wrapper is applied to the rounded tapered mouth end of a bunch. Aft motion in the direction J will take up slack in the wrapper inasmuch as the wrapper, when being applied to the tapered mouth end of the bunch, moves at a speed in excess of the linear speed of the rotating mouth end since the diameter of the mouth end is progressively smaller. Motion in the direction K changes the orientation of the flag carrier as it is presented to the mouth end about which it is being wrapped, since the mouth end is rounded and it is desirable to change the angle of presentation so that it is substantially tangential to the part of the mouth end on which the wrapper at that instant is being applied.

It will be understood that, because the wrapper is flat, or essentially so, and because the mouth end not only is tapering but also is rounded, it is not possible, in theory, to drape the wrapper smoothly on the mouth end. It is somewhat similar to attempting to wrap an egg with a flat strip. However, by reducing the pitch of the spiral, by reducing the slack, by reducing the width of the wrapper at the flag and by changing the angle of presentation of the wrapper to the rounded surface, a reasonably close approximation of smooth wrapping is obtained. Any lack of smoothness, and there inevitably must be some, is eliminated by the use of the header block 268 and, optionally, the cone roller 322, which leaves some unobjectionable flattened creases in the mouth end.

In order to provide oscillating movement about the axle 342, the flag carrier 208 is provided with a roller follower 346 that rides on a cam (not shown) suitably shaped to provide the desired change in angular position of the flag carrier according to a predetermined program that is adapted for the particular bunch. The inboard/outboard movement of the flag carrier is obtained by providing a roller follower 348 on the outboard side of the transporter 340, this follower being adapted to engage a cam (not shown) to position the flag carrier in its proper inboard/outboard position at any given time, depending upon the configuration of the mouth end of the particular bunch being wrapped. Finally, the fore and aft movement of the support 344 is obtained by a roller follower 350 which is mounted on one end of a bell crank 352 that is pivoted on a pin 354 on the carrier drum. The other end of the bell crank rides in a follower slot 356 in a flange 358 on the support 344. The roller follower 350 is engagable by a cam (not shown) that provides the proper degree of fore and aft movement required of the flag of a wrapper. Return springs maintain the sundry followers on their respective cams.

During wrapping of a bunch, the flag carrier is swung about the axle 342 in a counter-clockwise direction, being restored to idle position thereafter. During wrapping of a bunch, the transporter 340 is shifted in an inboard direction, being returned to its rest position after wrapping, and during wrapping of a bunch the support 344 is shifted aft, being returned to its rest position after wrapping is completed.

THIRD MODIFIED FORM OF THE INVENTION

When describing the wrapping head 50, it was mentioned that it would be economically desirable to have this wrapping head followed by a second wrapping head to pick up the alternate wrappers left on the vacuum belt by the patterned carrier drum, and it also was stated that the wrapping head 50 was designed for wrapping single-mouth-ended rather than double-mouth-ended bunches. In the machine 360 illustrated in FIGS. 35 and 36, two sequential wrapping heads 362, 364 have been illustrated and the machine has been shown for use in conjuction with double-mouth-ended bunches.

Each wrapping head is similar to the wrapping head for the machine 50 embodying, by way of example, a wrapping station that employs a belt such as shown in FIG. 33. The two wrapping heads have all the stations described for the machine 50, namely, each head includes a magazine 58, a bunch input transport means 62, a cigar output transport means 64, instead of a trimming means 66, a severing station 366, a source 70 of wrapper material, a slitting means 72, a wrapper pick-up station 74, a carrier drum 76, a pasting station 80, a wrapping station 154 including a belt 332, and a cigar discharge chute 184. A wrapper transport means 78 is common to both wrapping heads. A wrapper strip 82' is pulled from a roll 88 by a pair of feed rolls 90 and led between a slitting roller 94 and an anvil roller 92 to form a series of contiguous wrappers 84'. The wrappers 84' are twinned so as to provide a configuration that can spirally wrap two bunches that are coupled at their fire ends. Each wrapper includes one half X that is identical to a wrapper 84 and another half Y that is a mirror image of the half X and is in one piece therewith, being joined thereto at the apex 96' so that twinned wrapper is in the configuration of a "V" and successive wrappers are nested in one another as can be seen at the right-hand side of FIG. 36. Each wrapper half terminates in a trailing flag 98' identical to the flag 98 of the wrapper 84.

At the pick up station of the first head, alternate wrappers 84' are lifted from the transport means 78. At the pick up station of the second head, the remaining wrapper 84' are lifted. The carrier drum includes grooves big enough to accommodate twinned bunches and suction ports engaged to lift the twinned wrappers as well as a flag carrier for each end of each twinned wrapper. The wrapping takes place as described for a wrapper 84 except that the wrapper 84' is wrapped spirally about both halves of the twinned bunch in opposite directions. The flag carrier likewise functions in the manner heretofore described. After wrapping, the twinned cigars are separated at the severing station 366.

The machine 360 effectively constitutes the equivalent of four of the machines 50 and is capable of an output of about four hundred cigars a minute.

FOURTH MODIFIED FORM OF THE INVENTION

In the various embodiments of the invention previously described, the speed with which the bunches move around the carrier drum relative to the wrappers and to the rotary speed of the bunches about their individual longitudinal axes are dependent upon each other. It is useful to have these individually adjustable and, for this purpose and to provide, if desired, greater flexibility in the operation of the machine and a nicer way of spinning the bunches as they travel around the carrier drum, that is to say, a way which better confines the bunches than the mere rolling between two parallel surfaces, a machine 368 may be constructed in the fashion shown in FIGS. 37 - 39.

Said machine includes a carrier drum 76. This reference numeral is the same as the one used in describing the previous forms of the invention inasmuch as the carrier drum employed in the machine 368 and the equipment used to cut, paste and deposit wrappers thereon are identical with those used in FIGS. 1 - 36. The only difference between the machine 368 and the machine 50 is in the equipment used for rotating the individual bunches about their own longitudinal axes and for causing them to sweep along the carrier drum. This equipment includes a large number of spinner nests 370. The nests are mounted on a chain 372 in spaced relationship corresponding to the center-to-center spacing between wrappers brought to the wrapping station 154 by the carrier drum 76. The chain is trained about several sprockets, as 374, 376. The sprocket 374 is located at the beginning of the wrapping station 154 and there is a similar sprocket (not shown) at the exit end of the wrapping station. Between the sprockets 374, 376 the chain 372 passes through a curved slide 378 which defines a curved reach concentric about the axis of rotation of the carrier drum 76, thereby providing an annular gap 380 somewhat similar to the gap 206, except that the gap 380 is much broader and is not a rolling gap in the sense that it is spanned by a bunch being wrapped. Rather, the spinner nests 370 successively sweep through the gap 380 with the bunches contained and spun thereby touching the surface of the drum and engaging the wrappers that are applied spirally thereto. The sprocket 376, and possibly other sprockets of a similar nature, is employed to define a path of travel for the return reach of the chain 372.

Each rolling nest includes four rollers 382, 384, 386 and 388, the ends of which are journaled in spaced parallel bearing blocks 390. Optionally, the rollers may be fluted for better frictional engagement with a bunch. The rollers are located at the four corners of an imaginary rectangular parallelopiped which circumscribes a space in which a bunch to be spun is received. The rollers are so relatively positioned that in their aforesaid position they will bear loosely upon a bunch inserted amid them. All of the rollers are positioned at adjustable center distances in appropriate bearing blocks. Adjustment of these rollers will position the wrapper pick up surface of any diameter bunch in the same relative position to the drum surface. One or both of the smallest rollers 382 and 386 is shiftable between an idle position illustrated in the upper lefthand corner of FIG. 37 and an operative position shown in the lower right-hand corner of this FIG. When the roller is in its idle position, access is provided for transverse introduction of a bunch into the nest 370. When the roller is in its operative position, all four rollers jointly define the aforesaid space in which a bunch situated therein is captive.

To rotate the rollers 382, 384, 386 and 388 about their individual longitudinal axes several gears are provided. One of these is a sprocket 392 fixed to a shaft 394 that is journaled in the inboard bearing block 390. The sprocket 392 is integral with a drive gear 395. The drive gear 395 meshes with a pinion 400 on the roller 384. This pinion meshes with an idler 402 journaled in a swinging link and engages a pinion 406 on the roller 382. A similar arrangement of gearing powers the leading edge rollers 386, 388. This set of power and idler gears drive all the rollers in the same sense.

The rolling nests are driven along the slide 378 by arms 408 that move with the circumferential mounting plate 274. Said arms are formed with grooves 410 that couple with pins 412 extending from the outboard bearing plate 390. Said pins are engaged by the grooves as the nests reach the wrapping station 154 and sweep the nests through said station. Before the nests reach the entrance sprocket 374 (on the left-hand side of FIG. 37) they are in their idle position providing access to the nest. A bunch is fitted into the nest inasmuch as the open space giving entry to the nest at this time is facing upwardly. Immediately thereafter and before the nest faces downward, the moving nest moves past a striker member (not shown) which engages a link 404 and causes the rollers 382 and/or 386 to swing to their operative positions in which the nest is closed and in which all four rollers press lightly against the bunch in the nest.

A chain 414 is so located on the structure that it will be engaged by the sprocket 392 causing it and driving gear 395 to rotate. When this happens, all four rollers will commence to spin in the same sense and thereby will spin the bunch in the opposite sense, such latter sense being to spin the bunch in a direction suitable to cause an associated wrapper to be spiraled around the bunch with a stretching action. The chain is driven at a suitable speed to rotate the bunches at a proper speed to pick up the wrappers spirally applied thereto.

It thus will be seen that there are provided such machines and methods which achieve the various objects of the invention and which are well adapted to meet the conditions of practical use.

As various possible embodiments might be made of the above invention, and as various changes might be made in the embodiments and processes above set forth, it is to be understood that all matter herein described or shown in the accompanying drawings is to be interpreted as illustrative and not in a limiting sense.

We claim:

1. A machine for spirally applying wrappers to cigar bunches said machine including means for supplying bunches having fire ends and tapered mouth ends; means for supplying elongated wrappers having flag ends; a continuously moving bunch carrier; a continuously moving wrapper carrier; means for applying bunches to the bunch carrier spaced apart in the direction of movement of the bunch carrier and with their longitudinal axes perpendicular to said direction of movement; means for applying wrappers to the wrapper carrier spaced apart in the direction of movement of the wrapper carrier, with their longitudinal axes at the same acute angle to the direction of travel of the wrapper carrier and with the tip of each wrapper foremost; each of said carriers having a different predetermined path of travel; the paths of travel of said bunch carrier and of said wrapper carrier having common portions that are coextensive; the paths of travel of said bunch carrier and of said wrapper carrier approaching each other as they approach the coextensive common portions and the tip of each wrapper reaching the common portion before the balance of such wrapper; the tip of each wrapper being brought into contact with the fire end of an associated bunch as the bunch and wrapper reach the common portions; means to apply paste to the tip of each wrapper before the wrapper reaches the common portions so that said tip will adhere to the bunch when the tip is applied to the bunch; means to spin the bunches as they traverse the common portions while the bunches are bodily moving through the common portions in a direction perpendicular to their lengths; means to move each wrapper relative to its associated bunch at such a speed that the wrapper is spirally applied to the spinning bunch; suction means to hold the wrapper to the wrapper carrier as it is being applied; flag carriers on the wrapper carrier, each flag carrier being disposed to receive the flag end of a different wrapper supported on the wrapper carrier; and means to move the flag carrier relative to the wrapper carrier in a fore and aft direction and in an inboard/outboard direction, and to angularly rotate the flag carrier to apply the flag to the tapered mouth end of the associated bunch being wrapped in such a manner as nicely to apply the flag to the mouth end of the bunch in conformance with the configuration of said end, whereby the flag-ended wrappers are spirally wrapped about the bunches while moving the bunches and wrappers continuously from a point of application of the bunches and wrappers to their respective carriers to a point of delivery spaced from the point of application.

2. A machine as set forth in claim 1 wherein the pasting means applies paste to selected portions of each wrapper.

3. A machine as set forth in claim 1 wherein the bunches have rounded mouth ends, wherein means are provided to support each flag carrier on the wrapper carrier and to move the flag carrier in three modes consisting of fore and aft motion, inboard and outboard motion and rotary motion about the portion of the flag carrier associated with the tip of the flag to impart such motions to the flag carrier during the wrapping of the flag about the rounded tapered mouth end of a bunch so as to approximate the configuration of such mouth end.

4. A machine as set forth in claim 3 wherein the flag of each wrapper has a curlicue at its tip and wherein the means for imparting rotary motion to the flag carrier turns said carrier about an axis perpendicular to the drum at approximately the center of the curlicue.

5. A machine as set forth in claim 1 wherein the means for supplying bunches supplies the same intermittently to the moving bunch carrier.

6. A machine as set forth in claim 1 wherein means is included to provide a strip of wrapper material and wherein further means is provided continuously to cut wrappers from said strip and apply them intermittently to the wrapper carrier.

7. A machine as set forth in claim 6 wherein the wrapper cutting means includes a rotary cutter and an anvil.

8. A machine as set forth in claim 7 wherein the wrapper anvil is cylindrical and rotary.

9. A machine as set forth in claim 8 wherein the wrapper material constitutes a strip which is fed to the cutting means continuously and wherein the wrappers cut in the strip are in contiguous relationship.

10. A machine as set forth in claim 1 wherein shaping means is included to mold the mouth end of the cigar after the carrier wrapper has been wrapped around the bunch and wherein the shaping means moves with the bunch carrier and is synchronized with the spinning bunches.

11. A machine as set forth in claim 10 wherein means is included to shift the shaping means in a direction axially of a spinning bunch from a position spaced from the mouth end of the bunch into engagement with the mouth end of a bunch.

12. A machine as set forth in claim 10 wherein a rotatable cone is provided together with means to move the cone from an idle position spaced from the mouth end of the bunch to an operative position in frictional engagement with the mouth end of a wrapped bunch, the cone in operative position frictionally engaging the mouth end of the wrapped bunch and being spun, thereby to further shape the wrapped mouth end.

13. A machine as set forth in claim 1 wherein the flag end of each wrapper includes a curlicue and wherein the flag carrier is rotated during the application of a curlicue to an associated bunch.

14. A machine as set forth in claim 13 wherein the curlicue is suction-held to the flag carrier and wherein, upon release of the suction, the curlicue is released to the bunch and pressure is applied to pop the curlicue away from the flag carrier and across the tip of the bunch.

15. A machine as set forth in claim 1 which further includes means for cleaning and smoothing the wrapped and shaped mouth ends of cigars, said cleaning and smoothing means moving with wrapped cigars and into and out of engagement therewith.

16. A machine as set forth in claim 15 wherein the wrapped cigars move in a circular pattern during cleaning and smoothing and wherein the cleaning and smoothing means move in a matching synchronized pattern.

17. A machine as set forth in claim 16 wherein the wrapping and smoothing means comprises skeleton cups with open mouths and means to rotate said cups.

18. A machine as set forth in claim 1 wherein means is included to trim the fire end of each bunch after a wrapper has been applied to such bunch.

19. A machine as set forth in claim 1 wherein the wrapper carrier is a cylindrical drum.

20. A machine as set forth in claim 19 wherein the bunch carrier constitutes the same drum as the wrapper carrier.

21. A machine as set forth in claim 19 wherein the means to spin the bunches includes a stationary arcuate shoe concentric with the axis of rotation of the drum and spaced therefrom to define an arcuate gap slightly less in breadth than the diameters of the bunches whereby the bunches will be rolled by rotary motion of the drum while the bunches bear against the shoe.

22. A machine as set forth in claim 1 wherein means is provided to render the suction means progressively inoperable as associated parts of the wrapper are peeled off the wrapper carrier.

23. A machine as set forth in claim 10 wherein means is provided to support the shaping means for synchronous movement with moving bunches and for driving the shaping means at a fraction of the speed of the wrapper carrier.

24. A machine as set forth in claim 1 wherein the wrapper carrier constitutes a drum having suction outlet ports therein constituting the suction means and wherein the suction outlet ports are connected by passageways to divers suction inlet ports of a series of such ports in an end face of the drum, a vacuum ring riding on said end face, said ring having a port engaging said end face, said series of suction inlet ports crossing the port of said vacuum ring as the drum turns to supply suction to all the inlet ports of said series and sequestially to cut off said inlet ports as the outlet ports associated therewith and with the corresponding portions of the wrapper are applied to the bunch.

25. A machine as set forth in claim 22 wherein means is included to apply air under pressure to the inlet ports when there is no wrapper associated with the outlet ports so as to clean out the passageways.

26. A machine as set forth in claim 25 wherein the vacuum ring includes a pressure port across which the series of suction inlet ports sweeps once each revolution of the drum when there are no wrappers on the drum on the corresponding suction outlet port.

27. A machine as set forth in claim 1 wherein the wrapper carrier is a cylindrical drum, wherein means is provided to support each flag carrier on the drum and to move it in three modes consisting of fore and aft motion, inboard and outboard motion, and rotary motion about the portion of the flag carrier associated with the tip of the flag, and to impart such motions to the flag carrier during wrapping of the flag about the rounded tapered mouth end of a bunch so as to approximate the configuration of such mouth end, said supporting means including a pocket in the drum, a transalting link, means to mount the translating link in the pocket for rotary motion about an axis perpendicular to the axis of rotation of the drum, and means to mount the flag carrier on the free end of the translating link for rotary motion about an axis perpendicular to the axis of rotation of the drum.

28. A machine as set forth in claim 27 wherein the means to impart inboard and outboard motion and for and aft motion to the flag carrier comprises a follower on the translating link and a cam relative to which the follower moves, and wherein the means to impart rotary motion to the flag carrier comprises a follower on the flag carrier and a cam relative to which the last-named follower moves.

29. A machine as set forth in claim 27 wherein the means to support the flag carrier for the three modes of motion comprises a support movable in a fore and aft direction relative to the drum, a transporter movable relative to the support in an inboard and outboard direction, and an axle mounted on the transporter and supporting the flag carrier for rotation relative to the transporter about an axis perpendicular to the axis of rotation of the drum.

30. A machine as set forth in claim 1 wherein the means for supplying the wrappers comprises a strip of wrapper material and means for subdividing the strip into a series of contiguous narrow wrappers oriented with their longitudinal axes at an acute angle to the longitudinal axis of the strip, and with each wrapper including a tapered flag at its trailing end which terminates in a curlicue, the tip of the curlicue being separated from the tapered end by a slit.

31. A machine as set forth in claim 30 wherein the subdividing means is operable continuously along the length of the strip.

32. A machine as set forth in claim 30 wherein the means for supplying bunches supplies twinned bunches coupled at the fire ends, and wherein the subdividing means forms twinned chevron nested contiguous wrappers, the trailing end of each of which terminates in a tapering flag.

33. A machine as set forth in claim 1 wherein the means for spinning the bunches comprises nests, each nest constituting a cage composed of at least three parallel rollers into which a bunch is insertable and, when inserted, is lightly engaged by the three rollers, and means to spin all the rollers at the same linear speed and in the same sense.

34. A machine as set forth in claim 33 wherein means is included to swing a roller from an idle position in which it is spaced from a bunch in the cage to an operative position in which it engages a bunch in the cage, a bunch being fed to the cage when said roller is in its idle position and the roller being in operative position during application of the wrapper to the bunch.

35. For use in a machine as set forth in claim 1, a strip of wrapper material subdivided into a series of contiguous narrow wrappers oriented with their longitudinal axes at an acute angle to the longitudinal axis of the strip, and with each wrapper including a tapered flag at its trailing end which terminates in a curlicue, the tip of the curlicue being separated from the tapered end by a slit.

36. For use in a machine as set forth in claim 1, a strip of wrapper material subdivided into a series of twinned chevron nested contiguous wrappers, the trailing end of each of which terminates in a tapering flag.

37. A method of spirally applying wrappers to cigar bunches including supplying cigar bunches having fire ends and tapered mouth ends; supplying elongated cigar wrappers having flag ends; continuously moving the bunches along a predetermined path of travel, with the bunches spaced apart in their direction of movement and with their longitudinal axes perpendicular to said direction of movement; continuously moving the wrappers along a predetermined path of travel, with the wrappers spaced apart in their direction of movement and with their longitudinal axes at the same acute angle to said direction of movement and with the tip of each wrapper foremost; said predetermined paths of travel including common coextensive portions; the paths of travel of the bunches and of the wrappers approaching each other as they approach the coextensive common portion, and the tip of each wrapper reaching the common portion before the balance of each wrapper; bringing the tip of each wrapper into contact with the fire end of an associated bunch as the bunch and wrapper reach the common portions; applying paste to the tip of each wrapper before the wrapper reaches the common portions so that the said tip will adhere to the bunch when the tip is applied to the bunch; spinning the bunches as they traverse the common portions while the bunches are bodily moving through the common portions in a direction perpendicular to their lengths; moving each wrapper relative to its associated bunch at such a speed that the wrapper is spirally applied to the spinning bunch; holding flags on flag carriers as they are moved; imposing motion on the flag carriers relative to the movement of the wrappers, the imposed motion being in a fore and aft direction, in an inboard/outboard direction and rotatably about an axis perpendicular to the flag and located within the flag so as nicely to apply the flag to the mouth end of the bunch in conformance with the configuration of said end whereby the flagended wrappers are spirally wrapped about the bunches while moving the bunches and wrappers continuously from a point of application of the bunches and wrappers to their respective carriers to a point of delivery spaced from the point of application.

* * * * *